US006390491B1

(12) United States Patent
Hunter

(10) Patent No.: US 6,390,491 B1
(45) Date of Patent: May 21, 2002

(54) DOWNHILL SKI WITH INTEGRATED BINDING/TRACTION DEVICE

(76) Inventor: Lemna J. Hunter, 157 Anya Rd., Corrales, NM (US) 87048

( * ) Notice: Subject to any disclaimer, the term of this patent is extended or adjusted under 35 U.S.C. 154(b) by 0 days.

(21) Appl. No.: 09/570,750

(22) Filed: May 15, 2000

Related U.S. Application Data

(63) Continuation-in-part of application No. 09/314,361, filed on May 19, 1999.

(51) Int. Cl.[7] ..... A63C 7/10

(52) U.S. Cl. ..... 280/604; 280/605; 280/617; 280/618

(58) Field of Search ..... 280/602, 601, 280/607, 604, 605, 617, 618, 633, 632, 28.11; 188/5, 8

(56) References Cited

U.S. PATENT DOCUMENTS

| | | | | | |
|---|---|---|---|---|---|
| 2,756,063 | A | * | 7/1956 | Mercier | 280/604 |
| 3,715,126 | A | * | 2/1973 | Schwarz | 280/605 |
| 4,231,584 | A | * | 11/1980 | Kikuchi | 280/604 |
| 4,496,167 | A | * | 1/1985 | Krob et al. | 280/605 |
| 4,878,687 | A | * | 11/1989 | Stritzl et al. | 280/605 |
| 5,092,619 | A | * | 3/1992 | Leichtfried et al. | 280/605 |
| 5,516,141 | A | * | 5/1996 | Stritzl et al. | 280/605 |

FOREIGN PATENT DOCUMENTS

| | | | | |
|---|---|---|---|---|
| CH | 632415 | * | 10/1982 | 280/604 |
| CH | 637842 | * | 8/1983 | 280/604 |
| DE | 3140413 | * | 10/1981 | 280/604 |
| DE | 4204692 | * | 2/1992 | 280/604 |
| FR | 2613949 | * | 4/1987 | 280/604 |

* cited by examiner

*Primary Examiner*—Lanna Mai
*Assistant Examiner*—Hau Phan
(74) *Attorney, Agent, or Firm*—Marsh Fischmann & Breyfogle LLP

(57) ABSTRACT

A traction device for a downhill ski is disclosed. In one embodiment the traction device includes a traction member which is movably interconnected with the downhill ski. At least one biasing member actively biases this traction member toward a position where at least a portion of the traction member will extend beyond the entire lower surface of the downhill ski or an "active" position. However, the traction member can be retained in a non-traction or "inactive" position by a latch. Appropriate movement of the latch allows the biasing member(s) to move the traction member into the desired traction position. The end of a ski pole can be used to activate the latch and initiate movement of the traction member. In one embodiment this traction device is integrated with the structure of the binding. This allows the traction device to be automatically moved to its "active" position whenever a ski boot comes out of the binding, such that the traction device in this instance will act as a ski brake. However, the traction device can be selectively and manually moved to either its active or inactive position while the ski boot is disposed in the binding.

16 Claims, 17 Drawing Sheets

DOWNHILL SKI WITH INTEGRATED BINDING/TRACTION DEVICE

RELATED APPLICATIONS

This application is a continuation-in-part of U.S. patent application Ser. No. 09/314,361, which was filed on May 19, 1999, and which is entitled "DOWNHILL SKI WITH TRACTION DEVICE."

FIELD OF THE INVENTION

The present invention generally relates the field of downhill skis and, more particularly, to a traction device for allowing younger and/or less experienced skiers to proceed, via at least some degree of traction, on relatively flat surfaces, on mildly sloped declines, and up mildly sloped inclines such as those which are often encountered between the end of a ski run and the start of the next ski run.

BACKGROUND OF THE INVENTION

Downhill skiing is becoming an ever increasingly family-oriented sport. Younger and younger children are taking up downhill skiing and are demonstrating great abilities in maneuvering down relatively steep inclines, often with little or no fear. However, once gravity stops taking effect at the end of the run, many children and other less experienced skiers struggle on their skis. Children and even some adults often lack the ability to "skate" or "pole" effectively across the flat area or up the slight incline which is typically encountered at the end of the ski run when proceeding to the chair lift. It would be desirable to provide a downhill ski with a simple traction device which could readily be activated by even a child when needed to proceed along a flat surface or up an incline while still on downhill skis.

BRIEF SUMMARY OF THE INVENTION

The present invention generally relates to a traction device for a downhill ski. The downhill ski includes a nose or leading portion which is curved upwardly to a degree. The remainder of the downhill ski or its main body extends rearwardly from the nose at least generally along a reference axis (e.g., having a longitudinal extent). Downhill skis have a main body which is typically significantly longer than it is wide. The main body of the downhill ski may vary in width along its longitudinal extent to a small degree, and its lower or bottom surface may have a slight fore-to-aft curvature or along its longitudinal extent defined as being parallel with the noted reference axis, a slight side-to-side or laterally-extending curvature, or both. A binding is disposed somewhere in the mid portion (although not typically at the longitudinal midpoint) of the main body of the downhill ski on its upper surface. The binding includes a front binding member and a rear binding member which are spaced along the noted reference axis a sufficient distance to accept a downhill ski boot therein. These front and rear binding members may be interconnected and thereby attached as a unit to the ski, or they may be separately attached to the ski. Nonetheless, the downhill ski boot is securely retained within the binding and does not move relative to the ski unless/until the ski boot is removed entirely from the binding (e.g., when the skier falls).

A first aspect of the present invention is directed to a downhill ski at least generally of the above-noted type which includes a traction device. The traction device includes a mount or housing-like structure which is disposed on the upper surface of the main body of the downhill ski and which is appropriately attached to the downhill ski (e.g. through the upper surface of the main body of the downhill ski). The traction device may be positioned forward of the noted binding or rearward of the noted binding. A traction member is disposed along at least one of the sides of the main body of the downhill ski (preferably a traction member is disposed on each of the two sides of the main body of the downhill ski), extends rearwardly from the mount toward the rear end of the downhill ski, and includes a free end which is thereby longitudinally spaced from the mount in the direction of the rear of the downhill ski. A movable interconnection (e.g., pivotal) is provided between the noted traction member and the mount. This movable interconnection allows the noted free end of the noted traction member to move (e.g., pivot) from a position where its free end will not extend beyond the lower surface of the ski (a non-traction position), to a position where its free end will extend beyond the lower surface of the downhill ski (a traction position). At least one biasing member acts on the noted traction member (either directly or indirectly) to bias the free end of the noted traction member to its traction position. However, a latch is provided to prevent the noted traction member from moving from its non-traction position to its traction position until the latch is activated as well.

Various refinements exist of the features noted in relation to the subject first aspect of the present invention. Further features may also be incorporated in the subject first aspect of the present invention as well. These refinements and additional features may exist individually or in any combination. For instance, another movable interconnection (e.g., pivotal) can be provided between the latch and the mount or an extension thereof such that the latch may move (e.g., pivot) from one position where it is retaining the traction member in its non-traction position (e.g., via a concave holding aperture or "hook", having a "lip" on the latch), to another position where it sufficiently disengages such that the biasing member at least attempts to move the traction member to its traction position (e.g., the biasing member need not be strong enough to extend the free end of the traction member beyond the lower surface of the ski without first picking the ski up off the underlying surface to at least a small degree). The latch may be biased to engage the traction member to retain the same in its non-traction position, or to pivot at least generally in the direction of the portion of the associated traction member which is engaged by the latch when the traction device is in its non-traction position. A ski pole end receptacle or the like may be provided on the latch to allow the same to be activated by inserting the end of the ski pole therein and pushing the latch at least generally away from the engaged portion of the traction member, although a hand or any other mechanism may be used to move the latch in this manner for disengagement of the associated traction member. The latch may also include a ramped surface or the like for interfacing with its associated traction member when in a traction position. When the traction member is moved to push down on this ramped surface of the latch, the latch moves at least generally away from the portion of the traction member engaged by the latch when in a non-traction position, to a position where the latch can then move back toward the noted portion of the traction member to engage the same for retention of the traction member in its non-traction position.

The latch of the subject first aspect may be disposed relative to the mount such that the traction member or an extension thereof may extend beyond the movable interconnection at the mount and at least generally toward the latch for interfacing with the same. The latch may be disposed on either side of the mount to provide this function. In any case, the traction member may be characterized as undergoing a "teeter totter" like effect while pivoting relative to the mount, with the latch acting on one end of the "teeter totter" and with the other end of the traction member being on the opposite end of the "teeter totter". An extension of the traction device may project from the mount in interfacing relation with the ski's upper surface. This extension may have a significantly lower profile than the mount, and provides a surface on which the noted latch may be mounted.

A second aspect of the present invention is directed to a downhill ski at least generally of the above-noted type which includes a traction device which is operatively interconnected with the binding.

The traction device of the second aspect includes a traction device mount which is disposed on the upper surface of the ski body, a traction arm carrier which is movably (e.g., pivotally) interconnected with the traction device mount and is movable (e.g., pivotable) between at least first and second traction arm carrier positions, a first traction arm which is interconnected with the traction arm carrier and which is disposed along one of the sides of the ski body, a traction arm carrier biasing member which biases the traction arm carrier to its second traction arm carrier position, and a latch which is movable between first and second latch positions. The traction arm carrier is retained in its first traction arm carrier position by the latch when in its first latch position such that the first traction arm is "inactive," but is allowed to move to its second traction arm carrier position when the latch is disposed in its second latch position where the first traction arm is "active." In its "inactive" position the first traction arm does not engage the surface (e.g., snow) on which the downhill ski is traveling. In its "active" position the first traction arm does engage the surface (e.g., snow) on which of the downhill ski is traveling.

A latch trip member of the subject second aspect provides an interface between the binding and the traction device. In this regard, the latch trip member engages the latch so as to dispose the same in its second latch position whenever a ski boot is not disposed in the binding. Having the latch in its second latch position again allows the traction arm carrier biasing member to move the traction arm carrier to its second traction arm carrier position where the first traction arm is then "active." In this case the first traction member functions as a ski brake since the skier has become dislodged from the ski. However, the latch may also be manually moved between its first and second positions when a ski boot is disposed in the binding to activate or deactivate the traction device as desired. This then allows the ski to be used in normal downhill skiing operations and without the first traction arm engaging the underlying surface on which the downhill ski is traveling, but also allows the traction device to be activated to dispose the first traction arm so as to engage the underlying surface to the downhill ski, for instance to provide traction when "walking" up an incline with the ski boot still in the binding.

Various refinements exist of the features noted in relation to the subject second aspect of the present invention. Further features may also be incorporated in the subject second aspect of the present invention as well. The refinements and additional features may exist individually or in any combination. Preferably the second aspect further includes a second traction arm which is disposed on an opposite side of the ski body than the first traction arm. Each traction arm utilized by the traction device may have the following characteristics. Each traction arm may extend at least generally in the direction of the rear end of the ski body when the traction arm carrier is disposed in its second traction arm carrier position, as well as possibly when the traction arm carrier is disposed in its first traction arm carrier position. Each traction arm may include a free end which is longitudinally spaced from the traction arm carrier in the direction of the rear end of the ski body when the traction arm carrier is disposed in its second traction arm carrier position, as well as possibly when the traction arm carrier is disposed in its first traction arm carrier position. This free end of each traction arm may be configured so as to facilitate engagement with an underlying surface to the downhill ski so as to provide the desired traction function.

One way to desirably operatively interconnect the binding and traction device in relation to the subject second aspect of the present invention is to mount the latch trip member on a portion of the ski binding which moves in response to a change in position of a ski boot relative to the ski binding. This movement of the ski binding may then be used to move the latch trip member into a position where it will engage the latch to move the same from its first latch position to the second latch position at the desired time. Typically both the front binding member and the rear binding member move relative to the ski body when a ski boot is removed from the binding. Therefore, the latch trip member may be attached to either the front or rear binding member of the ski binding in a manner such that it moves to engage the latch when the ski boot becomes dislodged from the ski binding.

A third aspect of the present invention is directed to a downhill ski at least generally of the above-noted type which includes a traction device. The traction device includes at least one traction arm. Typically a pair of traction arms will be disposed on opposite side of the body of the downhill ski. In any case, the traction arm(s) is movable between first and second traction arm positions when the traction device is deactivated and activated, respectively. Moreover, the traction arm(s) extends at least generally in the direction of the rear end of the ski body to a free end at least when the traction arm(s) is disposed in its second traction arm position. Generally, the free end of the traction arm(s) extends below the lower surface of the ski body when the traction arm(s) is disposed in its second traction arm position so as to interface with the surface (e.g., snow) which underlies the downhill ski. Conversely, the free end of the traction arm(s) does not extend below the lower surface of the ski body when the traction arm(s) is disposed in its first traction arm position so as to not interface with the surface (e.g., snow) which underlies the downhill ski. Whenever a ski boot is not disposed in the ski binding, the traction device automatically disposes the traction arm(s) into its second traction arm position such that the free end of the traction arm(s) may interface with the underlying surface to the downhill ski. In this situation the traction arm(s) functions as a ski brake of sorts. When a ski boot is disposed in the binding, the traction device allows its traction arm(s) to be: 1) selectively disposed in its first traction arm position such that the free end of the traction arm(s) does not extend below the lower surface of the ski (e.g., for normal downhill skiing operations); and 2) selectively disposed in its second traction arm position such that the free end of the traction arm(s) does extend below the lower surface of the ski so as to interface with the underlying surface (e.g., to provide traction for proceeding in a forward direction on the particular underlying surface).

Various refinements exist of the features noted in relation to the subject third aspect of the present invention. Further features may also be incorporated in the subject third aspect of the present invention as well. These refinements and additional features may exist individually or in any combination. The traction device may be structurally integrated with either the front or rear binding assembly/component of the ski binding. One way to desirably structurally integrate the binding and traction device in relation to the subject third aspect of the present invention is to mount a latch trip member on a portion of the ski binding which moves in response to a change in position of a ski boot relative to the ski binding. This movement of the ski binding may then be used to move the latch trip member into a position where it will engage a latch to move the same so as to release the traction arm(s) such that it may be moved (e.g., biased) to its second traction arm position. Movement of the ski binding relative to the ski body as a ski boot is disposed in the ski binding may move the latch trip member into a position where it will not activate the latch. Instead, thereafter the latch may be manually moved to release the traction arm(s) to its second traction arm position, or thereafter the latch may be manually moved to return the traction arm(s) to its first traction arm position to be retained therein by the latch.

DETAILED DESCRIPTION OF THE INVENTION

Figure 1:
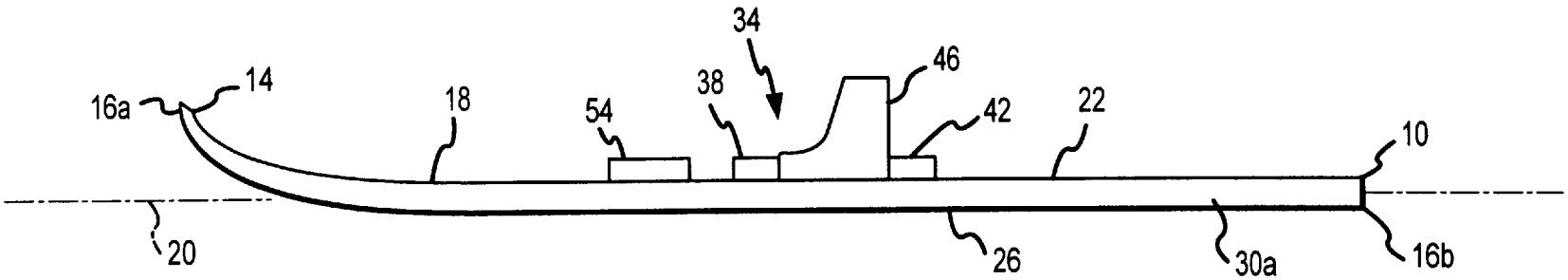
FIG. 1 is a side view of one embodiment of a downhill ski with a traction device generally illustrated thereon in accordance with principles of the present invention.

The present invention will now be described in relation to the accompanying drawings which assist in illustrating its various pertinent features. A downhill ski 10 is illustrated in FIG. 1 which extends at least generally longitudinally along a first reference axis 20 between a pair of longitudinally spaced ends 16*a*, 16*b*. The downhill ski 10 includes an upper surface 22 and a vertically displaced lower surface 26, as well as a pair of laterally displaced (relative to the reference axis 20) side surfaces 30*a*, 30*b*. The majority of the upper surface 22 is typically substantially planar, while the lower surface 26 may be substantially planar or alternatively may be contoured to a degree to vary the performance characteristics of the downhill ski 10 (e.g., to provide a degree of concavity extending from side 30*a* to side 30*b*).

The downhill ski 10 includes a first member or body 18 which is elongated and which extends at least generally along the noted first reference axis 20. The length of the downhill ski 10 between its ends 16*a*, 16*b* is typically significantly greater than its width between the side surfaces 30*a*, 30*b*. In one embodiment, the downhill ski 10 has a length to width ratio of at least about 8:1. The forward end 16*a* of the downhill ski 10 is defined by a nose 14 which curves upwardly from the body 18 of the downhill ski 10. Therefore, the tip of the nose 14 is vertically displaced from the upper surface 22 of the body 18 of the downhill ski 10.

A binding 34 is disposed on the upper surface 22 of the downhill ski 10 at an intermediate location between its longitudinally spaced ends 16*a*, 16*b*. The binding 34 includes a fore binding member 38 which is rigidly interconnected with the body 18 of the downhill ski 10 (e.g., detachably through one or more fasteners), as well as an aft binding member 42 which is also rigidly interconnected with the body 18 of the downhill ski 10 (e.g., detachably through one or more fasteners). The fore binding member 38 and the aft binding member 42 are longitudinally spaced along the first reference axis 20 to accept a rigid ski boot 46 therebetween. During normal operations of the downhill ski 10, there is no relative movement between the downhill ski 10 and the ski boot 46 because the ski boot 46 is securely retained in the binding 34. However and as known in the art, the binding 34 is set to release the ski boot 46 from the downhill ski 10 in certain situations (e.g., when desired by the skier to remove the ski 10 from the boot 46, in the event of a fall). It should be appreciated that the fore binding member 38 and the aft binding member 42 may be separately attached to the downhill ski 10 or may be part of a single unit which is in turn appropriately attached to the downhill ski 10.

A traction device 54 is also included on the downhill ski 10 of FIG. 1. Each downhill ski 10 of a given pair of skis will preferably have its own traction device 54. Details of the traction device 54 are presented in FIGS. 2–7 and are discussed in more detail below. Generally, the traction device 54 may be activated to allow a user of the downhill ski 10 to proceed in a forward direction with at least some degree of traction. Most often this will be when the skier is attempting to proceed along a substantially flat surface, down a slightly declined surface, or up a slightly inclined surface. Oftentimes flat and/or inclined surfaces are encountered between the end of a given ski run and the next chair lift. Activation of the traction device 54 will allow the skier to more diligently proceed along these types of surfaces. When the skier reaches the "end" of these types of surfaces, the traction device 10 may be deactivated so as to not interfere with the normal operations of the downhill ski 10. However and as will be evident after a review of the following, any inadvertent activation of the traction device 54 when skiing down the slope should not introduce a significant safety risk.

As clearly shown in FIG. 1, the traction device 54 is disposed at a location which is between the nose 14 of its associated downhill ski 10 and the fore binding member 38 of this downhill ski 10. The traction device 54 will typically be spaced from the fore binding member 38 a sufficient distance so as to not interfere with the operation of the binding 34, but yet still sufficiently close to the fore binding member 38 so as to provide easy access thereto by the skier when activation of the traction device 54 is desired. In one embodiment, the traction device 54 is disposed a distance from the fore binding member 38 (in the direction of the nose 14 and measured along the first reference axis 20) which is within the range of about 2 inches to about 6 inches. Different spacings could be utilized. Furthermore, the traction device 54 could also be mounted behind the aft binding member 42 or more specifically between the aft binding member 42 and the end 16*b* of the downhill ski 10.

Figure 2:
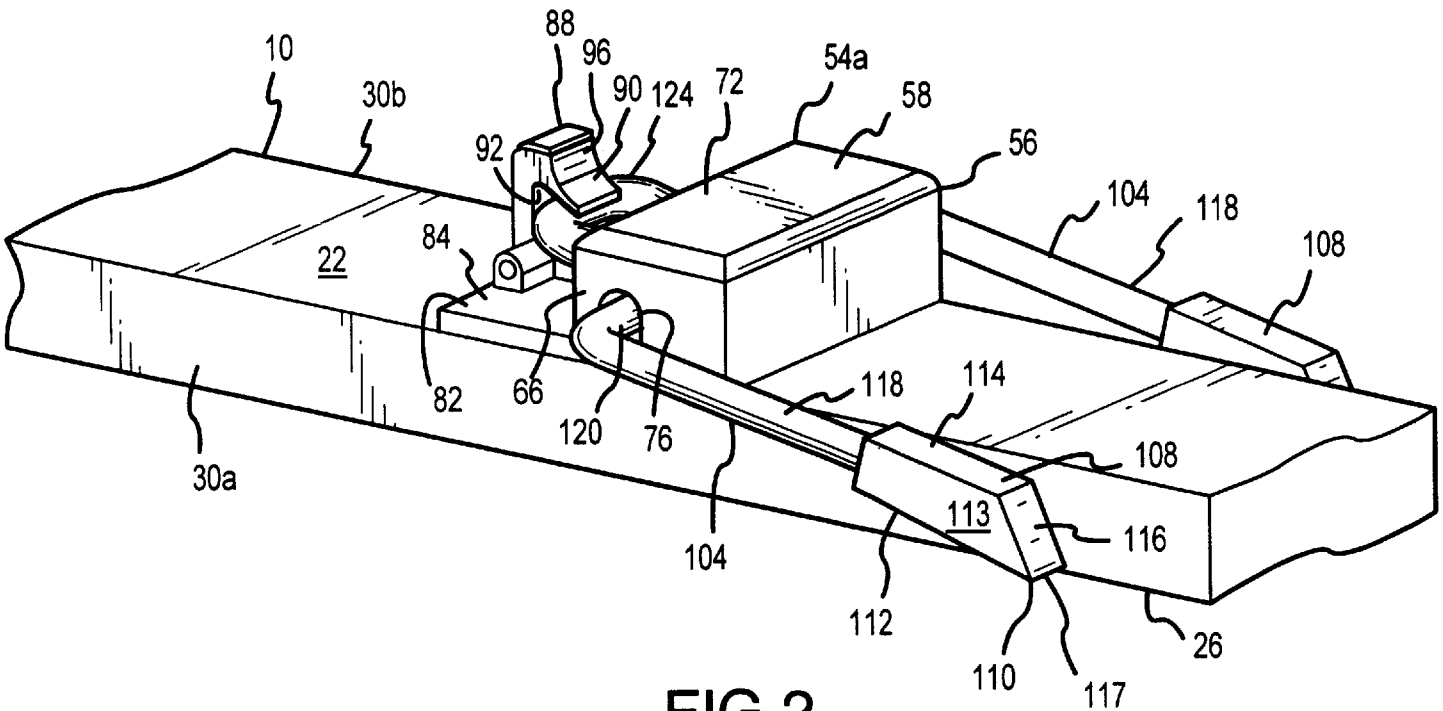
FIG. 2 is a perspective view of the downhill ski of FIG. 1 which illustrates one embodiment of a traction device in more detail and in an inactive or non-traction position.
Figure 3:
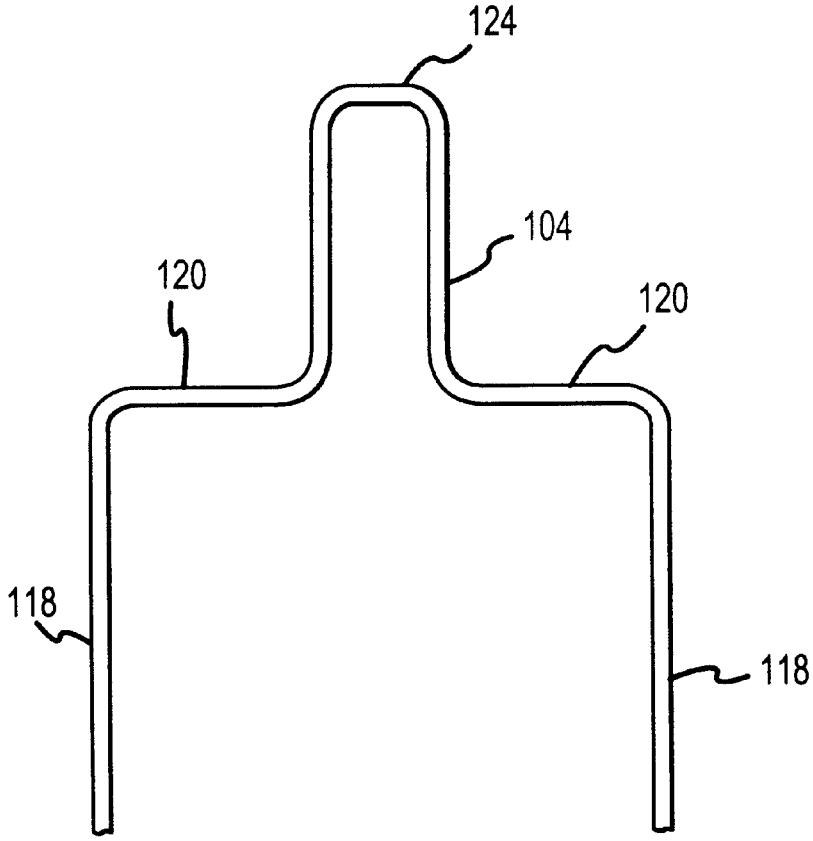
FIG. 3 is a plan view of a traction member of the traction device illustrated in FIG. 2.
Figure 4:
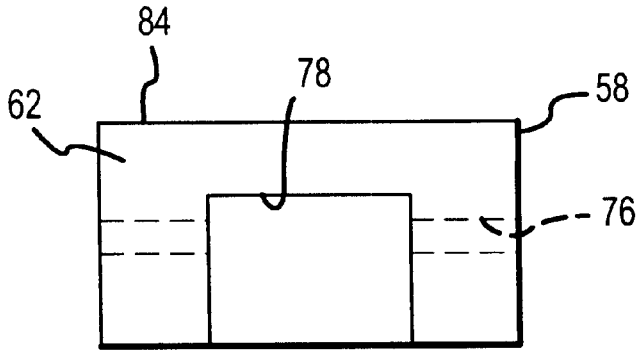
FIG. 4 is a front view of a mount of the traction device illustrated in FIG. 2 which allows for pivotal movement of the traction member of FIG. 3 between an inactive or non-traction position and an active or traction position.
Figure 5:
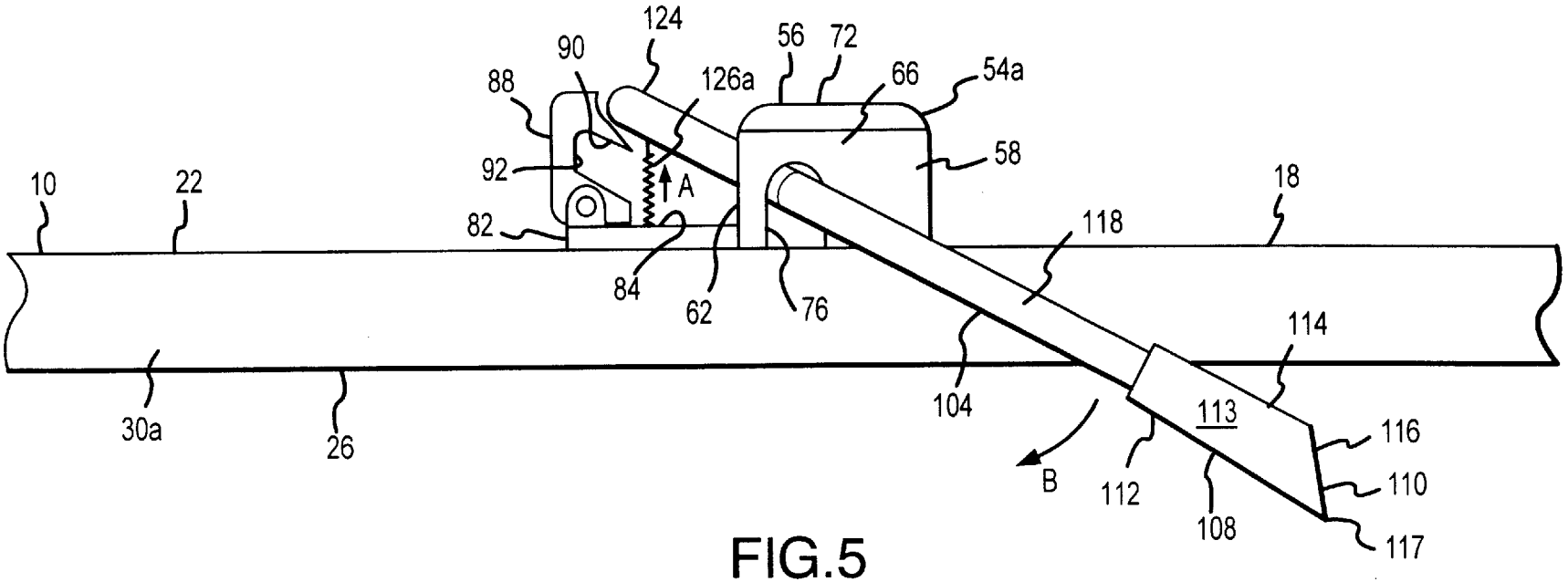
FIG. 5 is a side view of the downhill ski of FIG. 1 with the traction device of FIG. 2 in its active or traction position via one embodiment of a biasing member.
Figure 6:
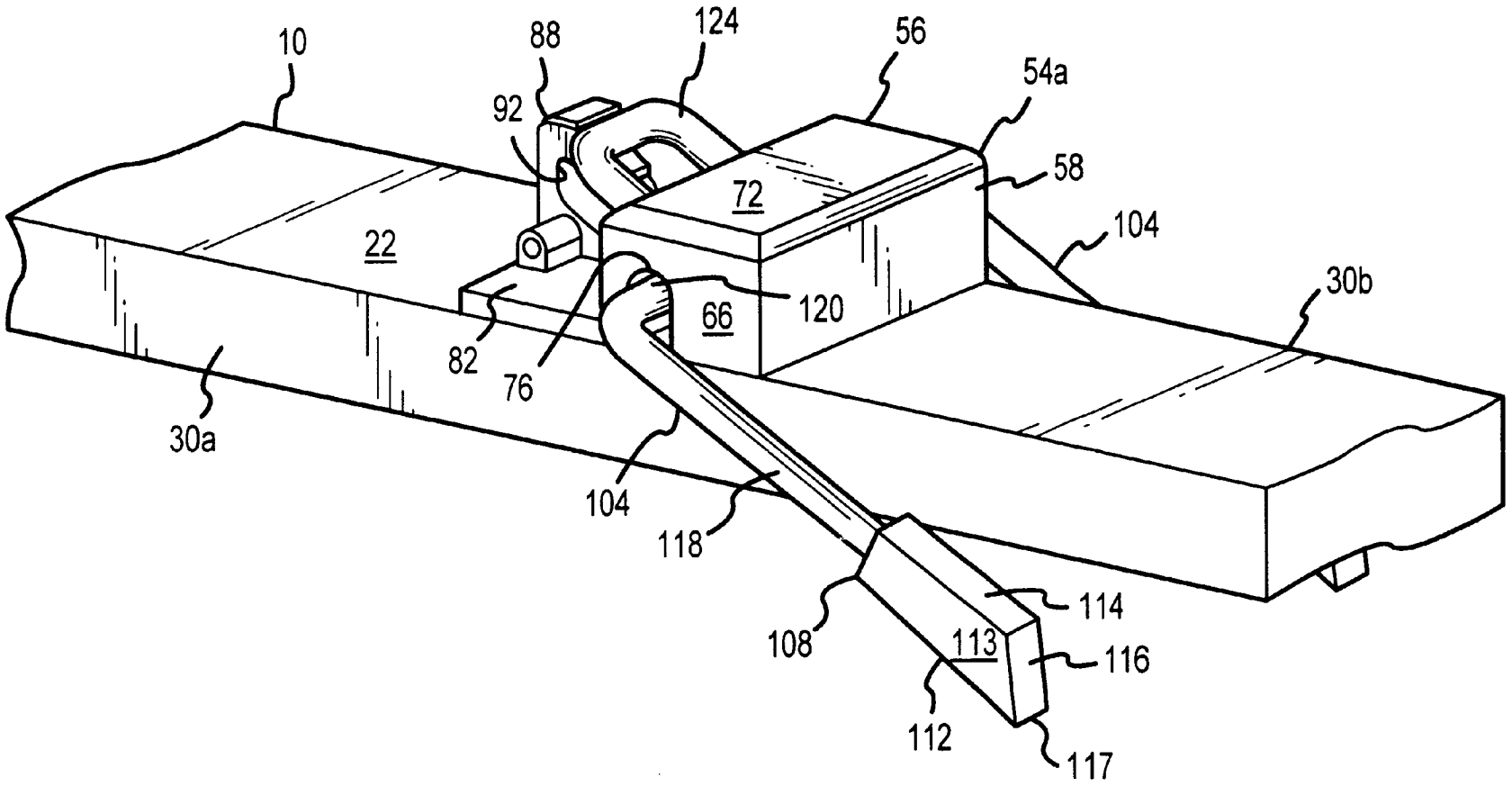
FIG. 6 is a perspective view of the arrangement presented in FIG. 5.
Figure 7:
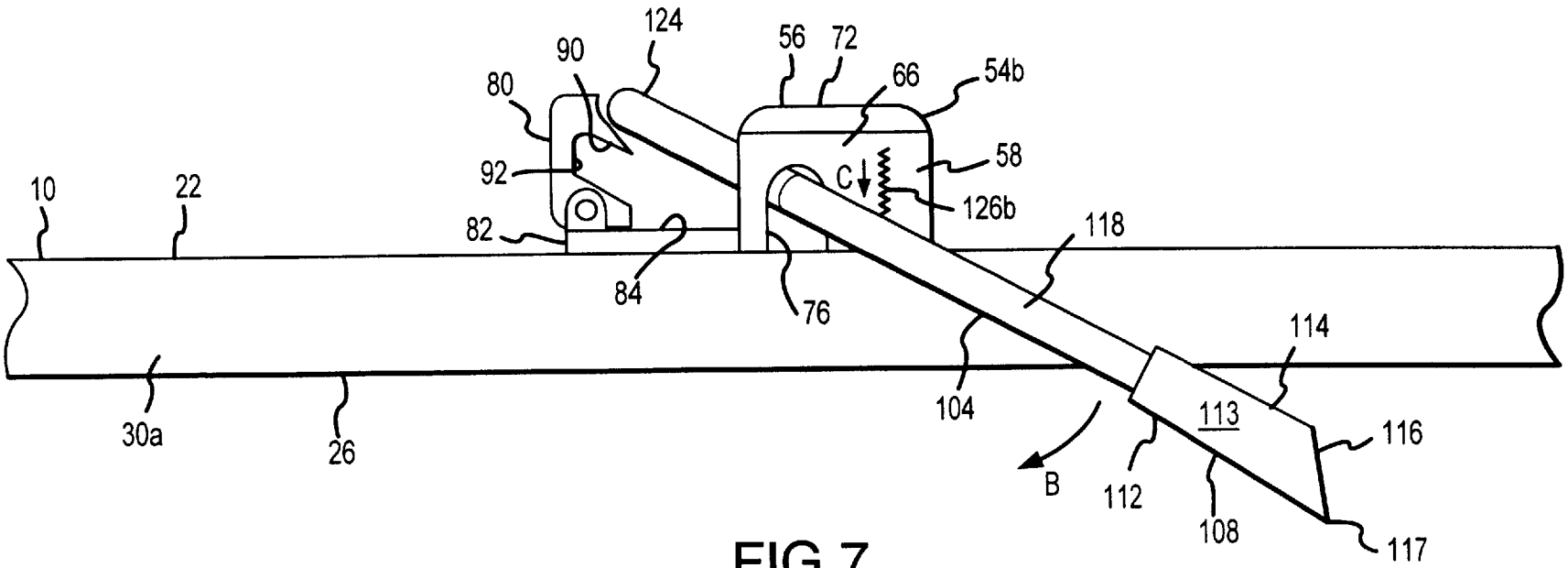
FIG. 7 is a side view of the downhill ski of FIG. 1 with the traction device of FIG. 2 in its active or traction position via another embodiment of a biasing member.
Figure 8:
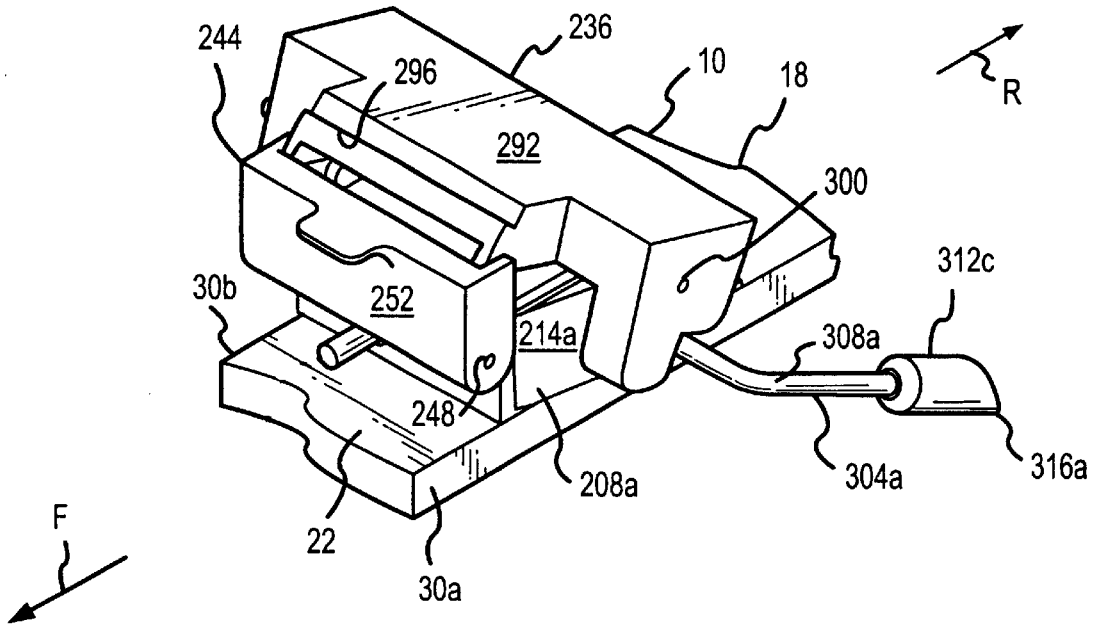
FIG. 8 is a perspective view of one embodiment of a traction device which is integrated with a front binding assembly of a downhill ski, with the front binding assembly being in a position when a downhill ski boot is out of the front binding assembly, and with the traction device being in its braking position.
Figure 9:
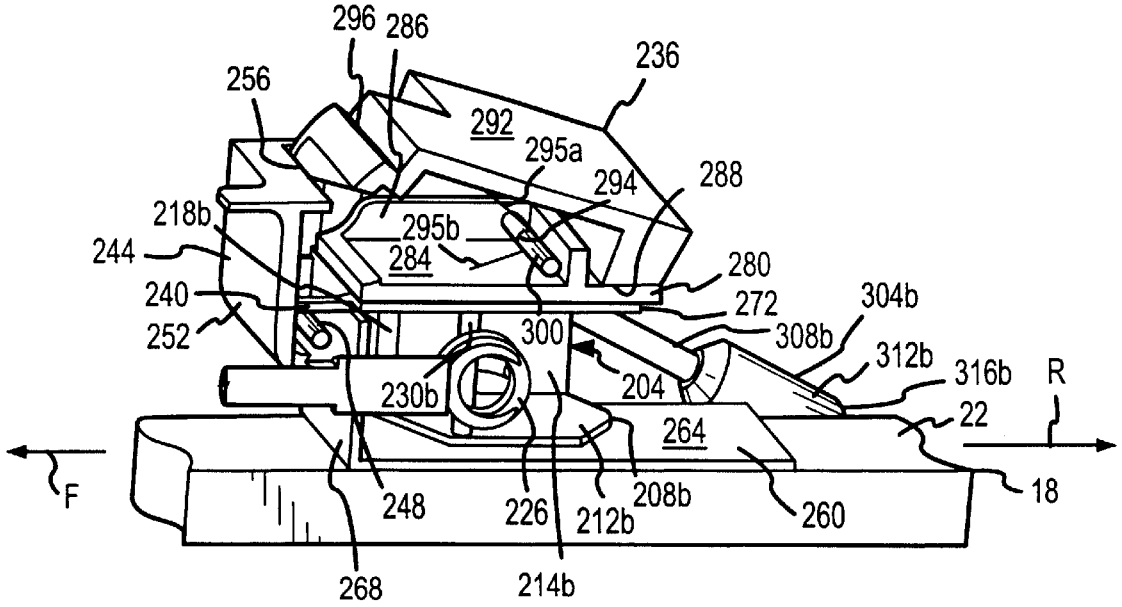
FIG. 9 is a cutaway, perspective view of the traction device and front binding assembly of FIG. 8, with the front binding assembly being in a position when a downhill ski boot is out of the front binding assembly, and with the traction device being in its braking position.
Figure 10:
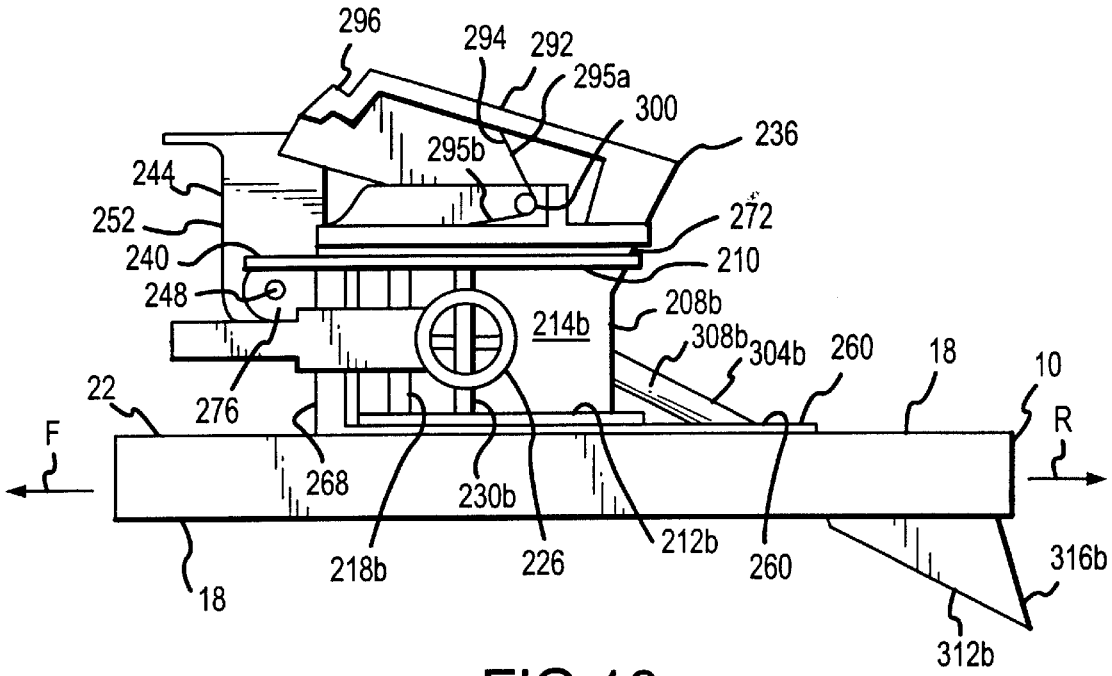
FIG. 10 is a cutaway, side view of the traction device and front binding assembly of FIG. 8, with the front binding assembly being in a position when a downhill ski boot is out of the front binding assembly, and with the traction device being in its braking position.

Details of one embodiment of the traction device 54 from the downhill ski 10 of FIG. 1 are presented in FIGS. 2–6 in the form of a traction device 54*a*. The traction device 54*a* generally includes a support structure 56 which is rigidly interconnected with the downhill ski 10, a traction member 104 which is movably interconnected with this support structure 56, a latch 88 which allows the traction member 104 to assume both a traction or active position (FIGS. 5–7) and a non-traction or inactive position (FIG. 2) through movement of the traction member 104 relative to the support structure 56, and at least one biasing member 126*a*, 126*b* which biases the traction member 104 toward its traction or active position (FIGS. 5–7). Referring first to FIGS. 2 and 4, the support structure 56 generally includes a mount 58 and an extension 82. Integral construction of the support structure 56 is contemplated (no joint between the extension 82 and the mount 58), as well as a multiple piece construction (at least one joint between the mount 58 and extension 82). Each of the mount 58 and corresponding extension 82 may be separately attached to the upper surface 22 of the downhill ski 10. Alternatively, by appropriately interconnecting the extension 82 and mount 58 (integrally or one which establishes at least one joint therebetween), it may be possible to only directly interconnect the support structure 56 and downhill ski 10 via the extension 82. Preferably, a detachable interconnection is used between the support structure 56 and the downhill ski 10 (e.g., through one or more fasteners which extend though an upper surface 84 of the extension 82 and into the upper surface 22 of the downhill ski 10). Moreover, preferably the support structure 56 is no wider than the downhill ski 10 to which it is attached such that it does not extend laterally beyond the side surfaces 30 of the downhill ski 10.

The extension 82 is disposed between the mount 58 and the nose 14 of the corresponding downhill ski 10 and has a lower profile than the mount 58 (i.e., an upper surface 72 of the mount 58 extends further from the upper surface 22 of the corresponding downhill ski 10 than the upper surface 84 of the extension 82 extends from this same upper surface 22 of the corresponding downhill ski 10). In one embodiment, the height of the extension 82 is no more than about 0.5 inches above the upper surface 22 of the downhill ski 10. Moreover, in one embodiment the upper surface 72 of the mount 58 is disposed a distance from the upper surface 22 of the downhill ski 10 which is within a range from about 1 inch to about 2 inches. The extension 82 could be disposed on a side of the mount 58 opposite to that illustrated in FIG. 2 to dispose the latch 88 in a position opposite to that shown in FIG. 2.

The traction member 104 is movably interconnected with its corresponding mount 58 for movement between its non-traction or inactive position (FIG. 2), and its traction or active position (FIG. 5) through the action of the biasing member(s) 126*a*, 126*b* which will be discussed in more detail below. Refer to FIGS. 2–3 where it can be seen that the traction member 104 is symmetrical in that it includes a pair of laterally spaced side sections 118, although asymmetrical configurations are possible. Each of these side sections 118 is generally axially extending and one side section 118 is disposed alongside each of the two side surfaces 30*a*, 30*b* of the body 18 of the downhill ski 10. Preferably there is a space between a given side section 118 and the corresponding side surface 30 of the body 18 of the downhill ski 10. In one embodiment, the spacing between a given side section 118 of the traction member 104 and its adjacent side surface 30 (taken perpendicularly to the first reference axis 20) is within a range of about ¼ inch to about ¾ inch.

Disposed on the end of each of the side sections 118 is a head 108 which extends away from its corresponding side section 118 and which defines a pair of free ends 110 for the respective traction member 104. Vertically spaced top and bottom surfaces 114 and 112 define a pair of laterally spaced side surfaces 113 for each head 108. In one embodiment, each of the top surface 114, the bottom surface 112, and the two side surfaces 113 of each head 108 are at least substantially planar. Other profiles may be appropriate. Regardless of the contour of the surfaces, 114, 112, and 113, the length of the top surface 114 may be less than the length of its corresponding bottom surface 112 for each of the heads 108. In this regard, a chamfer 116 interconnects the top surface 114 and its corresponding bottom surface 112 which is also a substantially planar surface in the illustrated embodiment. Other contours may be appropriate. The intersection between the chamfer 116 and its corresponding bottom surface 112 defines a traction edge 117 which is linear in the illustrated embodiment. In one embodiment, length of the traction edge 117 is within a range from about ½ inch to about 1-½ inches. In one embodiment, the angle between the chamfer 116 and its corresponding bottom surface 112 is within a range from about 30° to about 90°. These two traction edges 117 provide a desired interface between the traction member 104 and the surface over which the downhill ski 10 is progressing when the traction devices 54 is in its active or traction position.

Refer now to FIG. 3 where it can be seen that the traction member 104 includes a pair of pivot sections 120 which extend inwardly toward each other from their corresponding side section 118 (toward the first reference axis 20 when the traction device 54 is disposed on the downhill ski 10). These pivot sections 120 are supported within a first aperture 76 which extends laterally through the mount 58 (e.g., FIGS. 2 and 4), preferably perpendicular to the first reference axis 20 but nonetheless in a manner which allows the corresponding traction member 104 to pivot relative to its corresponding mount 58. In one embodiment, the center of the first aperture 76, and thereby a center of the pivot sections 120, is disposed a height above the upper surface 22 of the corresponding downhill ski 10 which is within a range from about ⅛" to about 1".

Extending forward from the pivot sections 120 of each traction member 104 (i.e., in the direction of the nose 14 of the subject downhill ski 10) is a latch interface section 124. Obviously if the latch 88 is disposed on a side of the mount 58 opposite to that illustrated in FIG. 2, the latch interface section 124 would also project in a direction at least generally opposite to that illustrated in FIG. 2. In one embodiment the latch interface section 124 is generally U-shaped. Other profiles may be appropriate. What is important is that there be a sufficient interface between the traction member 104 and its corresponding latch 88 so that the latch 88 can retain its corresponding traction member 104 in a non-traction or inactive position when so desired. In the illustrated embodiment the latch interface section 124 of a given traction member 104 extends through a second aperture 78 of the mount 58. From there it interacts with its corresponding latch 88 to retain the traction member 104 in its inactive or non-traction position (FIG. 2). The second aperture 78 is disposed on the front surface 62 of the mount 58 and extends rearwardly through the mount 58 (e.g., generally in the direction of the end 16*b* of the downhill ski 10) at least generally along the first reference axis 20 for intersection with the noted laterally extending first aperture 76. The height "h" of the second aperture 78 is selected such that the traction member 104 may pivot to its active or traction position for sufficient engagement of the traction edge 117 on the underlying surface. In one embodiment, the distance of the second aperture 78 from the upper surface 22 of the corresponding downhill ski 10 (measured along a line perpendicular to the upper surface 22) is within a range from about ½ inch to about 1 inch.

Although the traction member 104 has been described in multiple sections, it should be appreciated that the two side sections 118, the two pivot sections 120, and the latch interface section 124 may be integrally formed (no joint therebetween, and thereby a continuous structure), or may in fact be formed as separate pieces which are appropriately attached to each other (e.g., by glue, press fit, thermal bond) to define at least one joint between adjacent and separately formed sections). The head 108 may be integrally formed with the remainder of its corresponding traction member 104 (e.g., by molding), or may be separately attached thereto as well. In one embodiment, the head 108 of each traction member 104, its side sections 118, the pivot sections 120, and the latch interface section 124 are formed from materials such as steel or other appropriate metals, nylon, or other plastics. It's possible that a traction member 54 for a child's downhill ski 10 may be formed entirely from nylon or another suitable plastic, and that in an adult unit the side sections 118, pivot sections 120 and latch interface section 124 will be formed from steel or another appropriate metal, with the heads 108 being nylon or another suitable plastic.

The latch 88 of each traction device 54 is disposed forward of its corresponding mount 58, and thereby between its corresponding mount 58 and the nose 14 of its corresponding downhill ski 10 in the illustrated embodiment. However, the latch 88 could be disposed on a side of the mount 58 opposite to that illustrated in FIG. 2. Nonetheless, the latch 88 is pivotally interconnected with the extension 82 to allow the latch 88 to pivot along an axis which is at least generally perpendicular with the first reference axis 20. Although the latch 88 could be directly attached to the upper surface 22 of the downhill ski 10, preferably the extension 82 is used because it reduces the part count and makes for an easier installation.

The latch 88 includes what may be described as a concave holding aperture 92. Appropriate profiles for the concave holding aperture 92 include at least generally U-shaped or C-shaped configurations. Any configuration for the holding aperture 92 which will suitably retain the corresponding traction member 104 in its non-traction or inactive position may be used. More specifically, the latch 88 need only include some type of lip 90 or the like under which its corresponding traction member 104 may be retained, such that the holding aperture 92 is defined by the "concavity" underneath the lip 90.

Transfer of the traction member 104 from its inactive or non-traction position to its active or traction position is provided by moving the latch 88 from the position illustrated in FIG. 2 to the position illustrated in each of FIGS. 5–7. Facilitating this movement of the latch 88 is a ski pole end receptacle 96 which is provided on a surface of the latch 88 which projects at least generally toward the portion of the traction member 104 engaged by the latch 88. That is, the latch 88 may be moved from the position of FIG. 2 to the position of FIGS. 5–7 by disposing a ski pole end in the ski pole end receptacle 96, and at least generally pushing the latch 88 away from the engaged portion of the corresponding traction member 104 (in the direction of the nose 14 of the downhill 10 in the illustrated embodiment). However, the latch 88 may be disengaged in any other manner, such as by hand.

Another function of the ski pole receptacle 96 is that it defines a ramped surface of sorts to facilitate movement of the traction device 54 back to its non-traction position. When the user pushes a given traction member 104 towards its non-traction position, the latch interface section 124 strikes the ski pole end receptacle 96 and forces the latch 88 to rotate away from the latch interface section 124. When the latch interface section 124 clears the lip 90, the latch 88 maybe pivoted or rotated back toward the latch interface section 124 to capture the latch interface section 124 under the lip 90 of the latch 88. The latch 88 may be biased toward its "capturing" position by a spring or the like (i.e., biased toward engagement with its corresponding traction member 104).

Further facilitating the transfer of a given traction member 104 from its inactive or non-traction position to its active or traction position is at least one biasing member 126 which exerts an active force on the traction member 104 when being retained in the inactive or non-traction position. One type of biasing member 126 and one location for this biasing member 126 is illustrated in FIG. 5. Here the biasing member 126*a* is disposed forward of the mount 58 (i.e., between the mount 58 and the nose 14 of the corresponding downhill ski 10) and thereby acts on the latch interface section 124 of the traction member of 104 along a line corresponding with the arrow A to bias the traction member 104 for pivoting generally in the direction of the arrow B in FIG. 5. Multiple biasing members 126*a* could be used in the position generally illustrated in FIG. 5, such as by having a biasing member 126*a* acting on each side of the "U" of the latch interface section 124. Appropriate biasing members 126*a* include coil springs, leaf springs, torsion springs, weights, and the like.

Another appropriate location for a biasing member 126 to provide the desired biasing of the traction member 104 to its active or traction position is illustrated in FIG. 7. The traction device 54*b* is identical to that described in relation to FIGS. 2–6 except in relation to the biasing member 126*b*. As such, a "b" designation is used for the device 54*b* of FIG. 7 and the biasing member 126*b*. All other components are similarly numbered. The biasing member 126*b* illustrated in FIG. 7 is disposed on the opposite side of the pivotal axis of the traction member 104 than the biasing member 126*a* in FIG. 5. In this case the biasing member 126*b* exerts a force on the corresponding side section 118 which is at least generally in the direction of the arrow "C" to pivot the traction member 104 in the direction of the arrow B. The biasing member 126*b* could be of the types referenced in relation to the biasing member 126*a* discussed above. Moreover, each side section 118 of a given traction member 104 could have its own biasing member 126*b* to provide symmetrical pivoting forces.

Other types of biasing members could be used, and in locations other than as illustrated in FIGS. 5 and 7. For instance, a leaf spring or the like could be mounted about one or both of the pivot sections 120 and within the first aperture 76 of the mount 58. What is important is that the traction member 104 be actively biased for pivoting in the direction of the arrow B when the traction member 104 is being forcibly retained in its inactive or non-traction position by the latch 88. As such, when the latch 88 is moved away from its corresponding traction member 104 the biasing member(s) 126 will pivot the traction member 104 to its active or traction position.

The traction device 54 is a very simple way to provide a traction function for a downhill ski 10 without interfering with normal downhill skiing operations. When the latch 88 is moved from the position illustrated in FIG. 2 to the position illustrated in FIG. 5, the relevant biasing member(s) 126 exerts sufficient forces on the traction member 104 to pivot the traction member 104 so as to dispose the traction edge 170 below the lower surface 26 of the downhill ski 10 at least when the downhill ski 10 is disengaged from the underlying surface (e.g, when lifting the ski 10 up to a degree). That is, the traction edge 170 will be disposed below the lowermost extreme of the lower surface 26 relative to the upper surface 22 of the ski 10. When the skier then directs the downhill ski 10 back towards the underlying surface and also pushes rearwardly on the downhill ski 10, the traction edge 170 will dig into the underlying snow and/or ice to provide an abutment of sorts which may be pushed against to advance the skier in a forward direction. It is anticipated that pushing rearwardly on the downhill ski 10 while the traction edge 170 is engaged with the underlying snow and/or ice will actually cause the traction member 104 to further pivot in the direction of its traction position (e.g., to move further in the direction of the arrow B in FIG. 5).

When the downhill ski 10 advances forward and with the traction device 54 of a given ski 10 having been "activated", the traction member 104 should pivot toward its non-traction position at least to some degree. As such, this allows the traction device 54 to remain it is traction position while proceeding to and riding up the chair lift, and when dismounting the chair lift to proceed to the next run. That is, this allows the traction device 54 to be set in its traction position before boarding the ski lift, and alleviates the need for the skier to attempt to set the traction device 54 back to its non-traction position after boarding the ski lift and prior to dismounting from the same. Although having the traction device 54 in its traction position when dismounting the chair lift may induce a little bit of drag, it should not prevent the skier from skiing off of the lift and it may in fact be beneficial by reducing the speed at which the skier proceeds down the incline at the chair lift dismount area and to the flats that are typically encountered before each run. Thereafter, the skier may move the traction device 54 on each ski 10 back to its non-traction position before proceeding down the ski run. However, if the skier forgets to do this or if the traction device 54 is activated during the run, this should still allow the skier to proceed due to the noted pivoting of the traction member 104 toward its non-traction position when the associated ski 10 is proceeding in a forward direction, albeit at a possibly slower speed which may in fact be desirable in some instances.

Another embodiment of a device for providing a traction function to the type of downhill ski 10 presented in FIG. 1 is illustrated in FIGS. 8–17 in the form of a traction device 236. The traction device 236 of FIGS. 8–17 would replace the traction device 54 of FIGS. 1–7. One of the primary differences between the traction device 236 of FIGS. 8–17 and the traction device 54 of FIGS. 1–7 is that the traction device 236 is integrated with a front binding assembly 204. Recall that the traction device 54 was totally separate from the binding 34. Another difference is that the traction device 236 also functions as a brake for the downhill ski 10 when the ski boot 46 is out of or not in the front binding assembly 204. Since the traction device 54 as described above did not operatively interface with the binding 34, it was not intended to provide this brake function for a downhill ski.

Reference should now be made to FIGS. 8–17. Both the front binding assembly 204 and the traction device 236 are interconnected with a mounting bracket 260. This mounting bracket 260 is disposed on the upper surface 22 of the downhill ski 10 and is appropriately interconnected therewith. Any way of interconnecting the mounting bracket 260 to the body 18 of the ski 10 may be utilized (e.g., via one or more fasteners, in which case the mounting bracket 260 would be detachably interconnected with the body 18 of the downhill ski 10). The mounting bracket 260 includes a base 264 which is preferably flush with the upper surface 22 of the body 18 of the downhill ski 10. Other components of the mounting bracket 260 include a top 272, an end 268, and an extension 276. The top 272 is disposed in vertically spaced relation to the base 264 by the end 268. The extension 276 projects from the end 268 at least generally in the direction of the nose 14 or forward end 16*a* of the ski 10. This is represented by an arrow "F" which thereby designates the forward direction or front of the ski 10. Conversely, the direction of the rear end 16*b* of the ski 10, or the rearward direction or rear of the ski 10, is designated by an arrow "R."

The front binding assembly 204 is appropriately interconnected with the mounting bracket 260 as noted. There are a pair of laterally spaced toe plates 208*a*, 208*b* which principally define the front binding assembly 204. Each toe plate 208*a*, 208*b* includes a top 210*a*, 210*b* and bottom 212*a*, 212*b* which are disposed in vertically spaced relation by an at least generally vertically extending side 214*a*, 214*b* which is also part of the toe plate 208*a*, 208*b*. The bottom 212*a*, 212*b* of each toe plate 208*a*, 208*b* is disposed preferably flush with the base 264 of mounting bracket 260. A toe plate pivot pin 218*a*, 218*b* extends between the bottom 212*a*, 212*b* and top 210*a*, 210*b* of the toe plate 208*a*, 208*b*, and is appropriately mounted so as to provide a pivotal connection for the toe plates 208*a*, 208*b* (e.g., by extending within/through the base 264 of the mounting bracket 260). That is, each toe plate 208*a*, 208*b* is pivotable relative to each of the mounting bracket 260 and the body 18 of the downhill ski 10 as well.

Each toe plate 208*a*, 208*b* also includes a spring mounting pin 230*a*, 230*b* which extends between and is preferably maintained in fixed relation relative to its corresponding bottom 212*a*, 212*b* and top 210*a*, 210*b* so as to provide an appropriate anchorage for a toe plate spring 226. The toe plate spring 226 is interconnected with and extends between these laterally spaced spring mounting pins 230*a*, 230*b*. Movement of rear portions of the toe plates 208*a*, 208*b* away from each other, such as when a ski boot 46 (FIG. 1) is positioned within the front binding assembly 204 (the position illustrated in FIG. 16 and which is discussed below), is opposed by the toe plate spring 226. The spring 226 may also bias the toe plates 208*a*, 208*b* to the position illustrated in FIG. 12, such as when the ski boot 46 is out of the forward binding assembly 204. Activation of the traction device 236 to provide a braking function is provided by an action of the spring 226 on the toe plates 208*a*, 208*b*, namely when the ski boot 46 comes out of the front binding assembly 204 (e.g., a movement of the toe plates 208*a*, 208*b* by the spring 226 from the position illustrated in FIG. 16 to the position illustrated in FIG. 12). In this regard, part of the traction device 236 is incorporated into the front binding assembly 204. Specifically, a latch push arm 240 is fixedly mounted on at least one of the toe plates 208*a*, 208*b* to automatically activate the traction device 236 to provide a braking function when the ski boot 46 comes out of the font binding assembly 204 in a manner discussed in more detail below. Other configurations of a front binding assembly may utilize the traction device 236, so long as a latch trip of some type may be interconnected with a part thereof which changes position when the ski boot is in/out of the front binding assembly so as to interface with a latch 244 of the traction device 236 in the manner described herein.

The traction device 236 is also appropriately interconnected with the mounting bracket 260 as noted. Components of the traction device 236 include a latch 244 which is effectively an on/off switch of sorts for the traction device 236, a traction arm carrier 292 which is effectively a mounting body that cooperates with the latch 244 to provide active (braking or traction) and inactive (non-traction and non-braking) positions for the traction device 236, and a pair of laterally-spaced traction arms 304*a*, 304*b* which actually provide the braking or traction functions for the traction device 236. The latch 244 generally includes a latch body 252 and a latching member 256. The latch 244 is interconnected with the above-noted extension 276 of the mounting bracket 260 by an at least generally laterally extending latch pivot pin 248. The latch pivot pin 248 allows the latch 244 to move between at least generally two different latch positions to allow the traction device 236 to change between its active and inactive positions. In the illustrated embodiment, this movement is a pivoting of the latch 244 relative to the mounting bracket 260, as well as the body 18 of the ski 10. Other types of movements may be utilized to realize at least two different positions for the latch 244 to provide both active and inactive positions for the traction device 236. Note that the latch push arm 240 is disposed at a higher elevation than the latch pivot pin 248 so that the latch push arm 240 will pivot the latch 244 in a direction so as to "release" the traction arm carrier 292 at the appropriate time and in a manner which will be discussed in more detail below. The traction arm carrier 292 of the traction device 236 is interconnected with the mounting bracket 260 by a traction arm carrier mounting bracket 280, which is in turn appropriately fixedly interconnected with the mounting bracket 260 in any appropriate manner. The traction arm carrier mounting bracket 280 includes a base 284 which is preferably disposed flush with the top 272 of the mounting bracket 260. Extending at least generally upwardly from this base 284 are a pair of laterally spaced sides 286 of the traction arm carrier mounting bracket 280. Appropriately mounted to these sides 286 is a traction arm carrier pivot pin 300 which is at least generally laterally extending. The traction arm carrier 292 is mounted on this traction arm carrier pivot pin 300. Therefore, the traction arm carrier 292 is pivotally interconnected with the traction arm carrier mounting bracket 280, and thereby the body 18 of the downhill ski 10 as well.

Movement of the traction arm carrier 292 between at least two different traction arm carrier positions, based upon the position of the latch 244, provides for both the active and inactive positions for the traction device 236. When the latch 244 is in a first latch position, the latching member 256 of the latch 244 engages a latching member 296 of the traction arm carrier 292 so as to retain the traction device 236 in its inactive position. When the latch 244 is in its second latch position by a pivotal motion of the latch 244 which is at least initially generally away from the traction arm carrier 292, the latching member 256 of the latch 244 becomes sufficiently disengaged with the latching member 296 of the traction arm carrier 292. At this time, the traction arm carrier 292 pivots at least initially generally away from the latch 244 so as to dispose the traction arm carrier 292 in a second traction arm carrier position. This second traction arm carrier position corresponds with the active position for the traction device 236 and is that which is illustrated in FIGS. 8–11. The amount which the traction arm carrier 292 may pivot so as to dispose the traction device 236 in its active position is limited by establishing contact between a rear portion of the traction arm carrier 292 and a portion of the base 284 of the traction arm carrier mounting bracket 280 which may be characterized as a stop 288.

Appropriate forces are exerted on the traction arm carrier 292 to bias the same to its second traction arm carrier position, or the active position for the traction device 236. Virtually any way of biasing the traction arm carrier 292 to the second traction arm carrier position of FIGS. 8–11 may be utilized by the traction device 236. In the illustrated embodiment these biasing forces are provided by a traction arm carrier biasing spring 294 which is mounted on the traction arm carrier pivot pin 300. One leg 295*a* of the spring 294 engages the traction arm carrier 292, while the opposite leg 295*b* of the spring 294 engages the base 284 of the traction arm carrier mounting bracket 280. Generally, the spring 294 is configured such that its legs 295*a* and 295*b* attempt to move away from each other by a pivotal-type motion (about an axis corresponding with the traction arm carrier pivot pin 300) so as to apply the desired biasing forces against the traction arm carrier 292.

Appropriately mounted on the pivotable traction arm carrier 292, in fixed relation, are a pair of laterally spaced traction arms 304*a*, 304*b*. One traction arm 304*a* is disposed preferably at least slightly beyond the side surface 30*a* of the body 18 of the downhill ski 10, while the other traction arm 304*b* is disposed preferably at least slightly beyond the side surface 30*b* of the body 18 of the downhill ski 10 (e.g., there is at least preferably a small space between each traction arm 304*a*, 304*b* and its corresponding side surface 30*a*, 30*b* of the body 18 of the ski 10). Each traction arm 304*a*, 304*b* includes a body 308*a*, 308*b* which extends at least generally away from the traction arm carrier 292 in the rearward direction indicated by the arrow "R" when the traction device 236 is in both its active and inactive positions. An enlarged head 312*a*, 312*b* is disposed on a free end 316*a*, 316*b* of the traction arm 304*a*, 304*b*, which is opposite that end of the traction arm 304*a*, 304*b* which interfaces with the traction arm carrier 292. These heads 312*a*, 312*b* are least generally configured in the same manner as the heads 108 discussed above in relation to the traction device 54 of FIGS. 1–7 and for the same general purpose.

FIGS. 8–12 illustrate the traction device 236 in an active position and when the ski boot 46 is not in the front binding assembly 204. Whenever the ski boot 46 is not within the front binding assembly 204, the traction device 236 will be in this active position. "Active" means that the free end 316*a*, 316*b* of each traction arm 304*a*, 304*b* is disposed below a reference plane which at least generally contains the lower surface 26 of the ski body 18 (in at least the same general manner discussed above in relation to the traction device 54). In this case the toe plate spring 226 biases the toe plates 208*a*, 208*b* at least generally toward each other by a pivotal motion about their corresponding pivot pin 218*a*, 218*b* since the ski boot 46 is not in the front binding assembly 204, and such that the toe plates 208*a*, 208*b* assume the position illustrated in FIG. 12. At some point in time when the toe plates 208*a*, 208*b* move from the position illustrated in FIG. 16 (when the ski boot 46 is in the front binding assembly 204 and as will be discussed in more detail below) to the position illustrated in FIG. 12 (when the ski boot 46 is disengaged from or out of the front binding assembly 204), the latch push arm 240 attached to the toe plate 208*b* engages the latch 244 to pivot the same at least initially generally away from the traction arm carrier 292. When the latching member 256 of the latch 244 becomes sufficiently disengaged from the latching member 296 of the traction arm carrier 292 as a result of the action of the latch push arm 240 on the latch 244, the biasing forces provided by the traction arm carrier biasing spring 294 move the traction arm carrier 292 from the first traction arm carrier position illustrated in FIGS. 13–15 to the second traction arm carrier position illustrated in FIGS. 8–11. At this time the free ends 316*a*, 316*b* of the traction arms 304*a*, 304*b* are then disposed below a reference plane which at least generally contains the lower surface 26 of the body 18 of the ski 10. Since the ski boot 46 is not disposed in the front binding assembly 204, the active position of the traction device 236 illustrated in FIGS. 8–11 at this time may be characterized as providing a braking function for the downhill ski 10. That is, the traction device 236 in this type of active position retards, and more preferably stops, continued downhill travel of the ski 10 when the skier and ski 10 have become separated, such as typically results from a fall by the skier.

Figure 13:
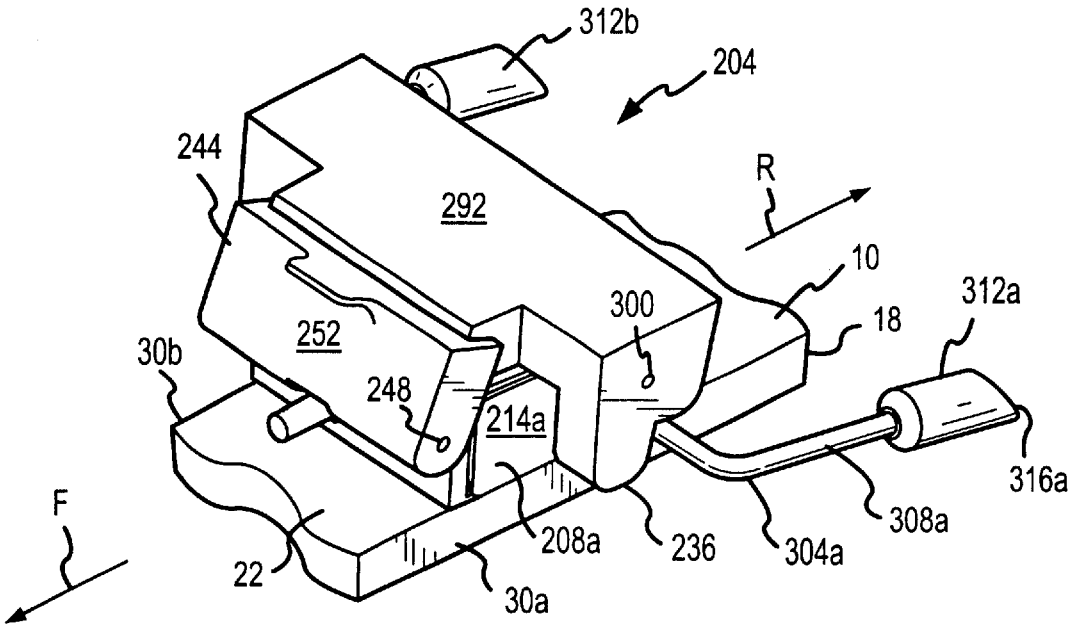
FIG. 13 is a perspective view of the traction device and front binding assembly of FIG. 8, with the front binding assembly being in a position when a downhill ski boot is in the front binding assembly, and with the traction device being in its non-traction position.
Figure 14:
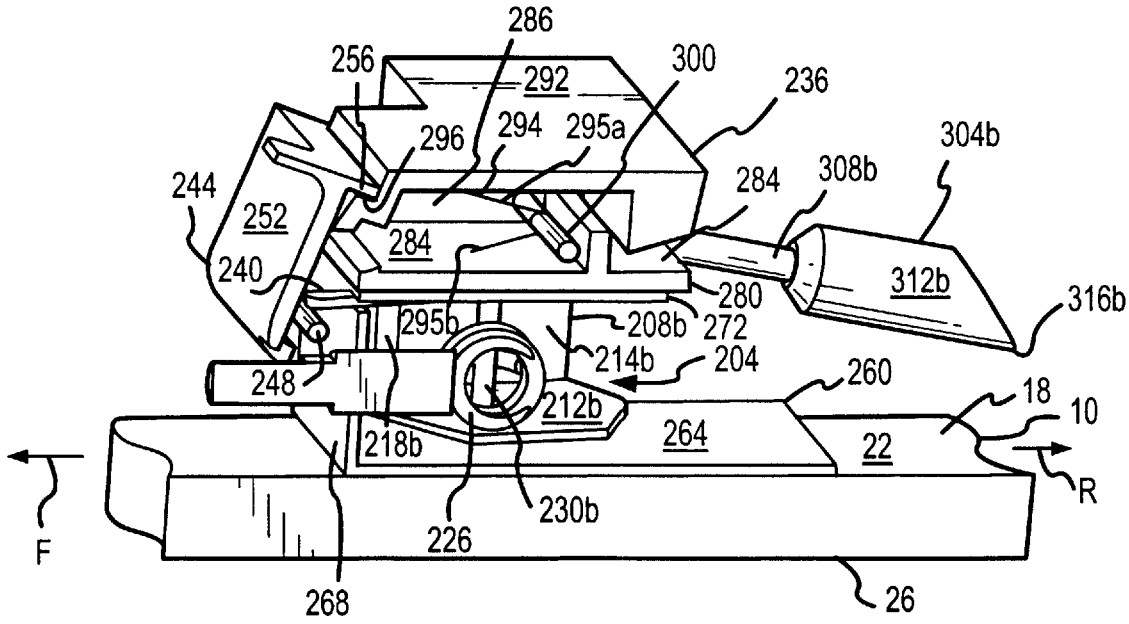
FIG. 14 is a cutaway, perspective view of the traction device and front binding assembly of FIG. 8, with the front binding assembly being in a position when a downhill ski boot is in the front binding assembly, and with the traction device being in its non-traction position.
Figure 15:
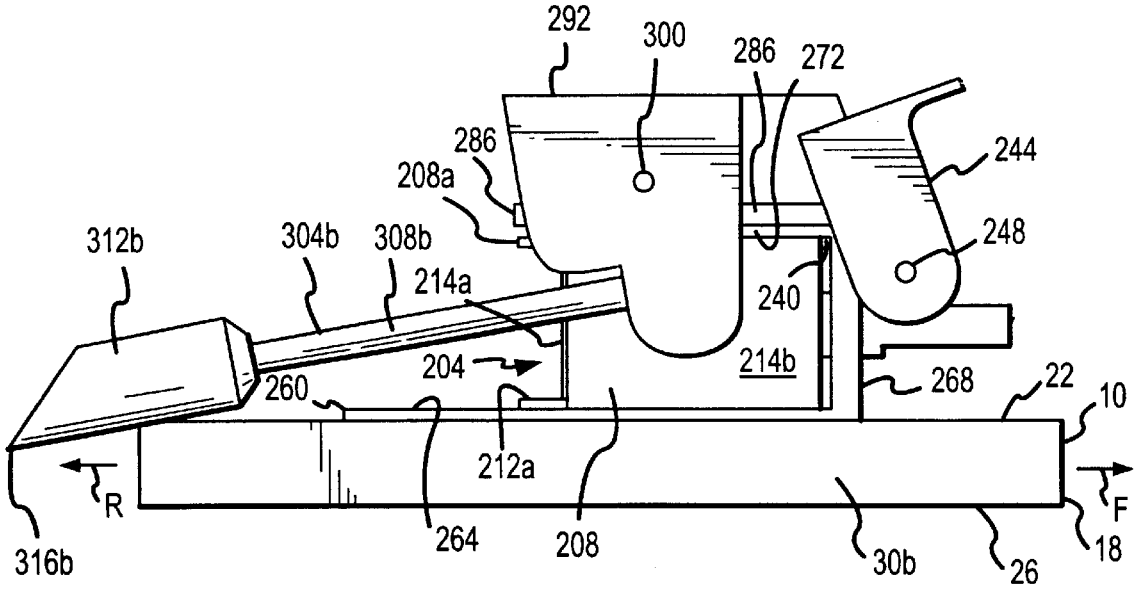
FIG. 15 is a side view of the traction device and front binding assembly of FIG. 8, with the front binding assembly being in a position when a downhill ski boot is in the front binding assembly, and with the traction device being in its non-traction position.

FIGS. 13–15 illustrate the latch 244 being in its first latch position so as to retain the traction arm carrier 292 in its first traction arm carrier position, all at a time when the ski boot 46 is disposed within the front binding assembly 204. This again corresponds with the inactive position for the traction device 236. Note in FIG. 16 how rear portions of the toe plates 208*a*, 208*b* have pivoted at least generally away from each other about their respective pivot pins 218*a*, 218*b* as a result of the insertion of the ski boot 46 within the front binding assembly 204. Movement of the toe plates 208*a*, 208*b* from the position illustrated in FIG. 12 (where the ski boot 46 is not yet disposed within the front binding assembly 204) to the position illustrated in FIG. 16 (where the ski boot 46 is disposed within the front binding assembly 204) sufficiently disengages the latch push arm 240 from the latch 244 (including being totally disengaged therefrom such that there is actually a space between the latch push arm 240 and the latch 244). As a result: 1) the traction arm carrier 292 may be manually moved (e.g., by the skier using the downhill ski 10) from the second traction arm carrier position of FIGS. 8–11 to the first traction arm carrier position of FIGS. 13–15; and 2) the latch 244 may be manually moved (e.g., by the skier using the downhill ski 10) from the second latch position of FIGS. 8–11 to the first latch position of FIGS. 13–15. Engagement of the latching member 256 of the latch 244 with the latching member 296 of the traction arm carrier 292 at this time retains the traction device 236 in its inactive position, even though the ski boot 46 is engaged with the front binding assembly 204. This then allows the ski 10 to be used for normal downhill skiing operations as discussed above in relation to the traction device 54. That is, the free end 316*a*, 316*b* of each traction arm 304*a*, 304*b* is disposed above a reference plane which at least generally contains the lower surface 26 of the body 18 of the ski 10 with the traction device 236 being in its inactive position, such that the device 236 does not interfere with normal downhill skiing operations. Conventional ski brakes cannot be manually manipulated in this manner, but are instead automatically returned to a "non-braking" position.

Figure 11:
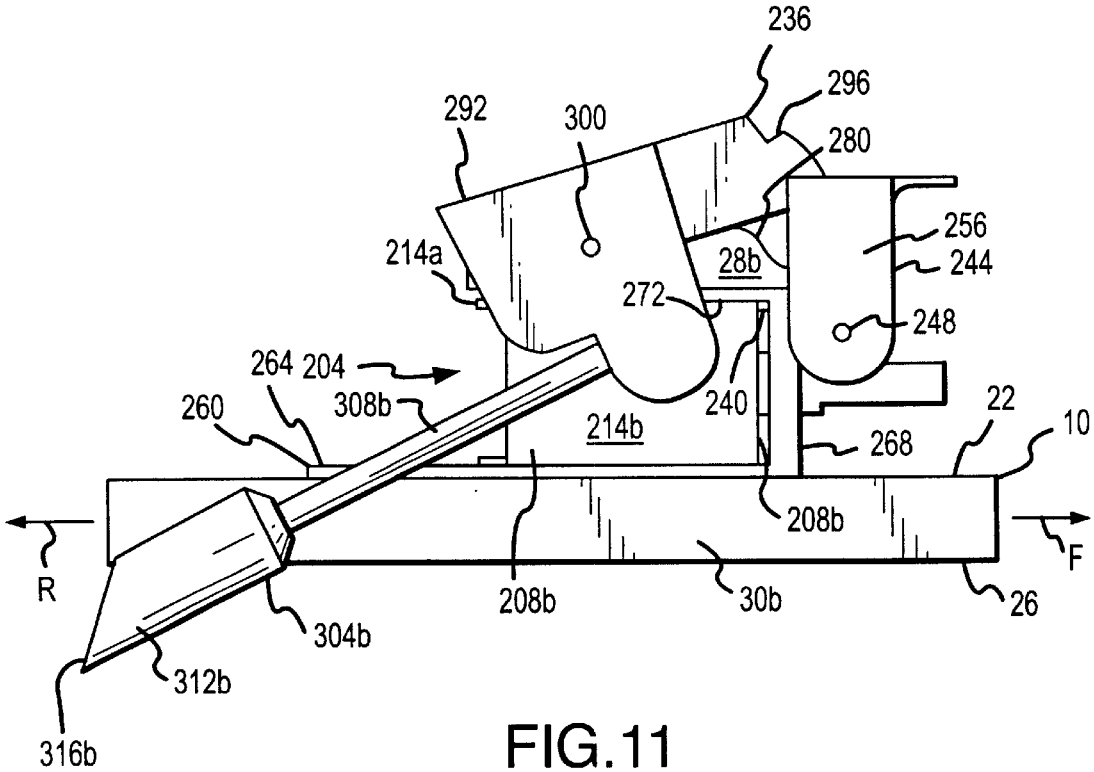
FIG. 11 is a side view of the traction device and front binding assembly of FIG. 8, with the front binding assembly being in a position when a downhill ski boot is out of the front binding assembly, and with the traction device being in its braking position.
Figure 12:
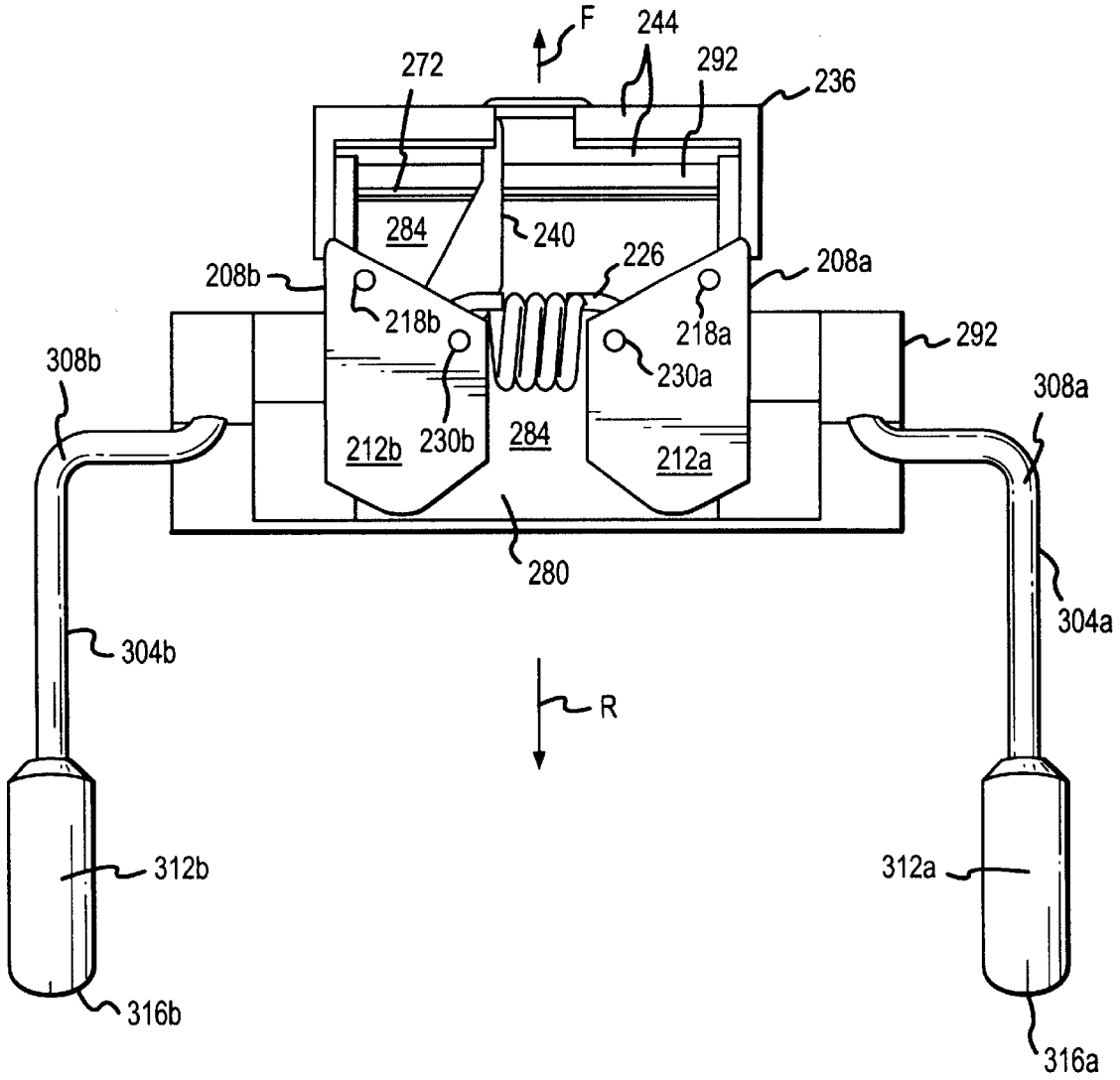
FIG. 12 is a bottom, plan view of the traction device and front binding assembly of FIG. 8, with the ski and certain portions of the traction device being removed, with the front binding assembly being in a position when a downhill ski boot is out of the front binding assembly, and with the traction device being in its braking position.
Figure 17:
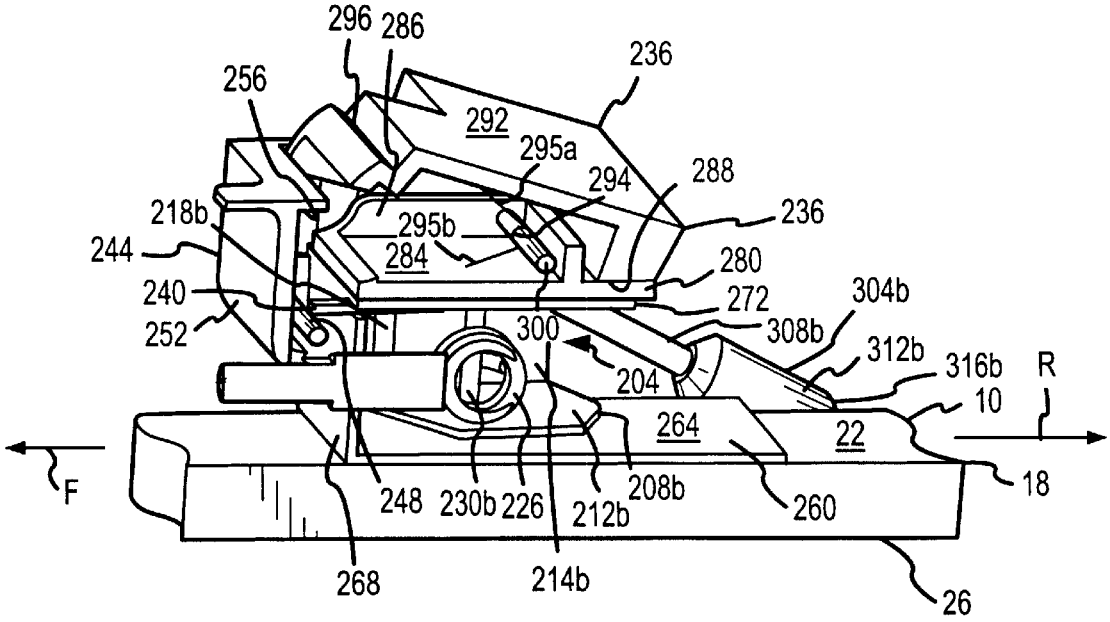
FIG. 17 is a cutaway, side view of the traction device and front binding assembly of FIG. 8, with the front binding assembly being in a position when a downhill ski boot is in the front binding assembly, and with the traction device being in its traction position.
Figure 16:
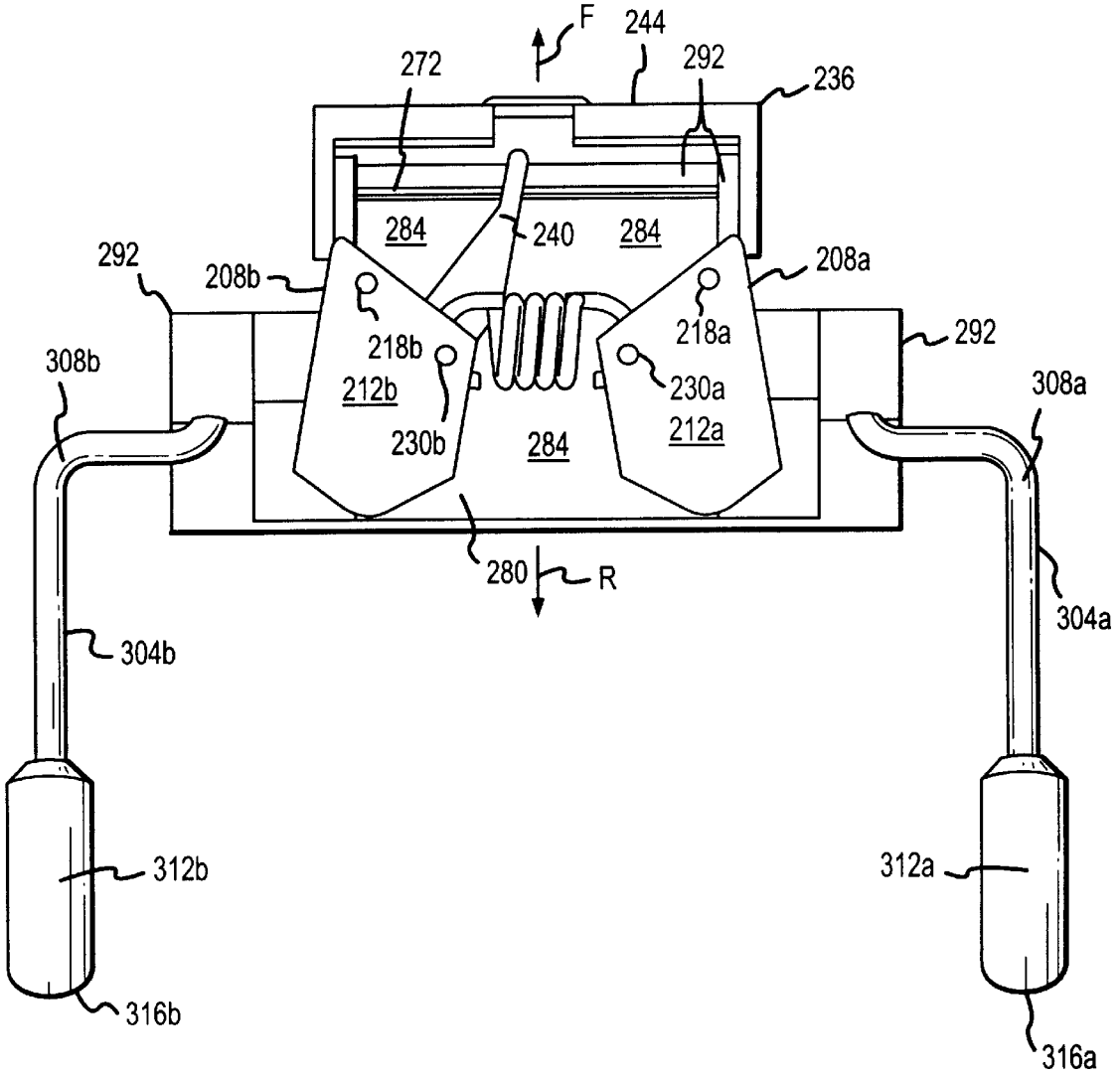
FIG. 16 is a bottom, plan view of the traction device and front binding assembly of FIG. 8, with the ski and certain portions of the traction device being removed, with the front binding assembly being in a position when a downhill ski boot is in the front binding assembly, and with the traction device being in its non-traction position.

The latch 244 may also be manually moved from the first latch position illustrated in FIGS. 13–15 to the second latch position illustrated in FIG. 17 (e.g. by a skier using the ski 10, and which corresponds to the same general position illustrated in FIGS. 8–11 and discussed above) while the ski boot 46 is still disposed within the front binding assembly 204. Movement of the latch 244 from its first latch position to its second latch position allows the traction arm carrier 292 to move from the first carrier arm position illustrated in FIGS. 13–15 to the second carrier arm position illustrated in FIG. 17 with the ski boot 46 being within the front binding assembly 204. Forces again are exerted on the traction arm carrier 292 by the traction arm carrier biasing spring 294 to bias the traction arm carrier 292 to its second traction arm carrier position. Disposition of the traction arm carrier 292 in its second carrier position in turn disposes the free end 316*a*, 316*b* of each traction arm 304*a*, 304*b* below a reference plane which at least generally contains the lower surface 26 of the body 18 of the ski 110. This is the same position which the traction arm carrier 292 and the traction arms 304*a*, 304*b* assume when the ski boot 46 is out of the front binding assembly 204 and which is illustrated in FIG. 11. From this point on the traction device 236 functions at least substantially the same as the traction device 54 which was discussed above in relation to FIGS. 1–7.

Another embodiment of a device for providing a traction function to the type of downhill ski 10 presented in FIG. 1 is illustrated in FIGS. 18–23 in the form of a traction device 352. The traction device 352 of FIGS. 18–23 would replace the traction device 54 of FIGS. 1–7. One of the primary differences between the traction device 352 of FIGS. 18–23 and the traction device 54 of FIGS. 1–7 is that the traction device 352 is integrated with a rear binding assembly 324. Recall that the traction device 54 was totally separate from the binding 34. Another difference is that the traction device 352 also functions as a brake for the downhill ski 10 when the ski boot 46 is out of or not in the rear binding assembly 324. Since the traction device 54 as described above did not operatively interface with the binding 34, it was not intended to provide this ski brake function.

Reference should now be made to FIGS. 18–23. Both the rear binding assembly 324 and the traction device 352 are interconnected with a mounting bracket 328. This mounting bracket 328 is disposed on the upper surface 22 of the downhill ski 10 and is appropriately interconnected therewith. Any way of interconnecting the mounting bracket 328 to the body 18 of the ski 10 may be utilized (e.g., via one or more fasteners, in which case the mounting bracket 328 would be detachably interconnected with the body 18 of the downhill ski 10). The mounting bracket 328 includes a base 332 which is preferably flush with the upper surface 22 of the body 18 of the downhill ski 10, and a pair of laterally-spaced sides 344 which extend at least generally upwardly therefrom. The majority of the traction device 352 is disposed on a rear section 340 of the base 332 of the mounting bracket 328. The rear binding assembly 324 is disposed on a front section 336 of the base 332 of the mounting bracket 328. The direction of the nose 14 or forward end 16*a* of the ski 10, or the forward direction or front of the ski 10, is designated by an arrow "F." Conversely, the direction of the rear end 16*b* of the ski 10, or the rearward direction or rear of the ski 10, is designated by an arrow "R."

The rear binding assembly 324 is appropriately interconnected with the mounting bracket 328 as noted, and includes rear binding components 326*a*, 326*b*, and 326*c*. The entire rear binding assembly 324 is slidably interconnected for movement relative to the mounting bracket 328 in a direction which is at least substantially parallel with the longitudinal extent of the body 18 of the ski 10. An appropriate biasing mechanism (e.g. one or more springs) biases the rear binding assembly 324 toward the front of the ski 10 or in the direction of the arrow "F" (e.g., so as to be more forwardly disposed when a ski boot 46 is not within the rear binding member 324). Activation of the traction device 352 to provide a braking function is provided by an action of this biasing mechanism on the rear binding assembly 324, namely when the ski boot 46 comes out of the rear binding assembly 324 (e.g., a movement of the rear binding assembly by the biasing mechanism from the position illustrated in FIG. 20 to the position illustrated in FIG. 18). In this regard, part of the traction device 352 is incorporated into the rear binding assembly 324. Specifically, a latch pull arm 356 is fixedly mounted on the rear binding assembly 324 to automatically activate the traction device 352 to provide a braking function when the ski boot 46 comes out of the rear binding assembly 324 in a manner which will be discussed in more detail below. Other configurations of a rear binding assembly may utilize the traction device 352, so long as a latch trip of some type may be interconnected with a part thereof which changes position when the ski boot is in/out of the rear binding assembly so as to interface with a latch 360 of the traction device 352 in the manner described herein.

The traction device 352 is also appropriately interconnected with the mounting bracket 328 as noted. Components of the traction device 352 include a latch 360 which is effectively an on/off switch of sorts for the traction device 352, a traction arm carrier 376 which is effectively a mounting body that cooperates with the latch 360 to provide active (braking or traction) and inactive (non-traction and nonbraking) positions for the traction device 352, and a pair of laterally-spaced traction arms 388 which actually provide the braking or traction functions for the traction device 352. The latch 360 generally includes a latch body 368 and a latching member 372. The latch 360 is interconnected with the sides 344 of the mounting bracket 328 by an at least generally laterally extending latch pivot pin 364. The latch pivot pin 364 allows the latch 360 to move between at least generally two different positions to allow the traction device 352 to change between its active and inactive positions. In the illustrated embodiment, this movement is a pivoting of the latch 360 relative to the mounting bracket 328, as well as the body 18 of the ski 10. Other types of movements may be utilized to realize at least two different positions for the latch 360 to provide both active and inactive positions for the traction device 352. Note that the latch pull arm 356 is disposed at a higher elevation than the latch pivot pin 364 so that the latch pull arm 356 will pivot the latch 360 in a direction so as to "release" the traction arm carrier 376 at the appropriate time and in a manner which will be discussed in more detail below.

The traction arm carrier 376 of the traction device 352 is interconnected with the sides 344 of the mounting bracket 328 as well. Appropriately mounted to and extending between these sides 344 is a traction arm carrier pivot pin 380 which is thereby at least generally laterally extending. The traction arm carrier 376 is mounted on this traction arm carrier pivot pin 380. Therefore, the traction arm carrier 376 is pivotally interconnected with the mounting bracket 328, and thereby the body 18 of the downhill ski 10 as well.

Movement of the traction arm carrier 376 between at least two different traction arm carrier positions, based upon the position of the latch 360, provides for both the active and inactive positions for the traction device 352. When the latch 360 is in a first latch position, the latching member 372 of the latch 360 engages a latching member 384 of the traction arm carrier 376 so as to retain the traction device 352 in its inactive position. When the latch 360 is in its second latch position by a pivotal motion of the latch 360 which is at least initially generally away from the traction arm carrier 376, the latching member 372 of the latch 360 becomes sufficiently disengaged with the latching member 384 of the traction arm carrier 376. At this time, the traction arm carrier 376 pivots at least initially generally away from the latch 360 so as to dispose the traction arm carrier 376 in a second traction arm carrier position. This second traction arm carrier position corresponds with the active position for the traction device 352 and is that which is illustrated in FIG. 18.

Appropriate forces are exerted on the traction arm carrier 376 to bias the same to its second traction arm carrier position, or the active position for the traction device 352. Virtually any way of biasing the traction arm carrier 376 to the second traction arm carrier position of FIG. 18 may be utilized by the traction device 352. In the illustrated embodiment these biasing forces are provided by a traction arm carrier biasing spring 382 which is mounted on the traction arm carrier pivot pin 380. One leg 383*a* of the spring 382 engages the traction arm carrier 376, while the opposite leg 383*b* of the spring 382 engages the base 332 of the mounting bracket 328. Generally, the spring 32 is configured such that its legs 383*a* and 383*b* attempt to move away from each other by a pivotal-type motion (about an axis corresponding with the traction arm carrier pivot pin 380) so as to apply the desired biasing forces against the traction arm carrier 376.

Appropriately mounted on the pivotable traction arm carrier 376, in fixed relation, are a pair of laterally spaced traction arms 388*a*, 388*b*. One traction arm 388*a* is disposed preferably at least slightly beyond the side surface 30*a* of the body 18 of the downhill ski 10, while the other traction arm 388*b* is disposed preferably at least slightly beyond the side surface 30*b* of the body 18 of the downhill ski 10 (e.g., there is at least preferably a small space between each traction arm 388*a*, 388*b* and its corresponding side surface 30*a*, 30*b* of the body 18 of the ski 10). Each traction arm 388*a*, 388*b* includes a body 392*a*, 392*b* which extends at least generally away from the traction arm carrier 376 in the rearward direction indicated by the arrow "R" when the traction device 352 is in both its active and inactive positions. An enlarged head 396*a*, 396*b* is disposed on a free end 398*a*, 398*b* of the traction arm 388*a*, 388*b*, which is opposite that end of the traction arm 388*a*, 388*b* which interfaces with the traction arm carrier 376. These heads 396*a*, 396*b* are least generally configured in the same manner as the heads 108 discussed above in relation to the traction device 54 of FIGS. 1–7 and for the same general purpose.

Figure 18:
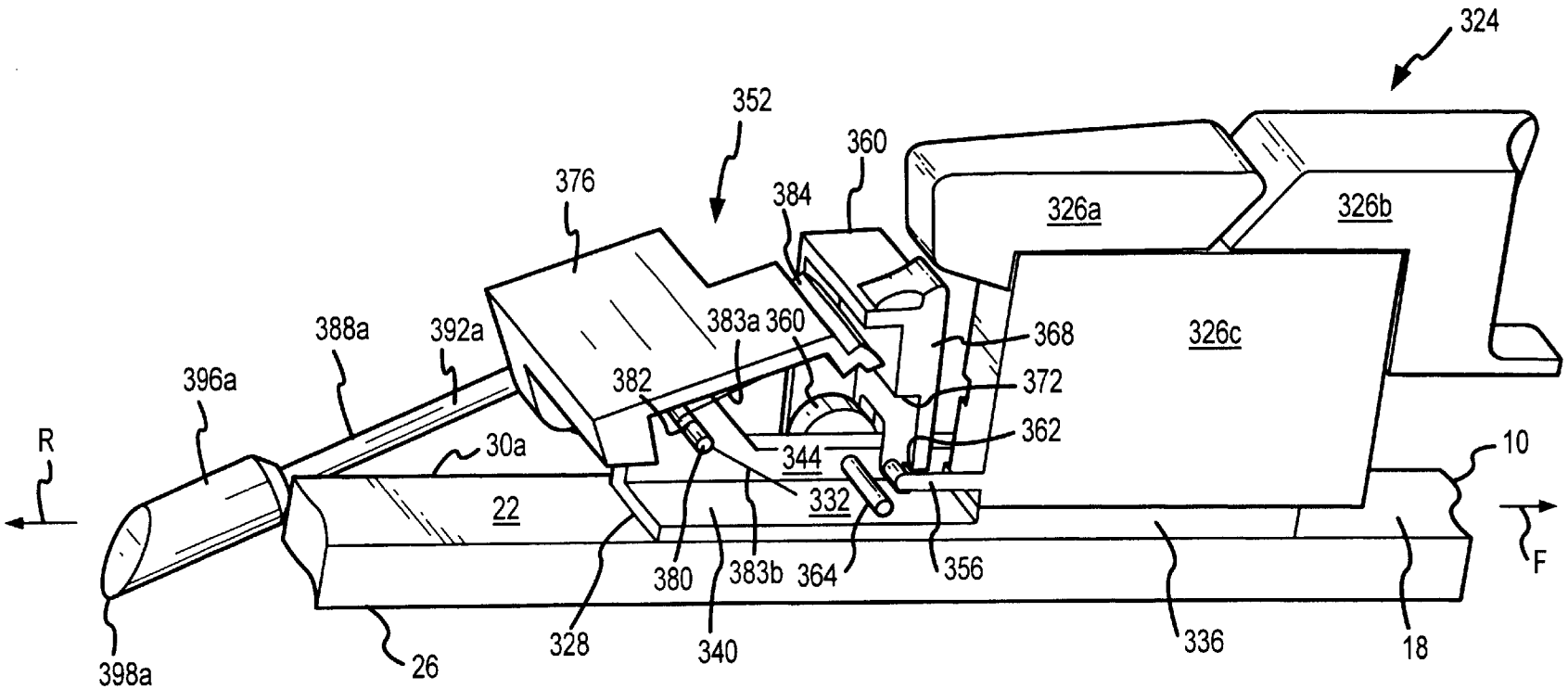
FIG. 18 is a perspective, cutaway view of one embodiment of a traction device which is integrated with a rear binding assembly of a downhill ski, with the rear binding assembly being in a position when a downhill ski boot is out of the rear binding assembly, and with the traction device being in its braking position.
Figure 19:
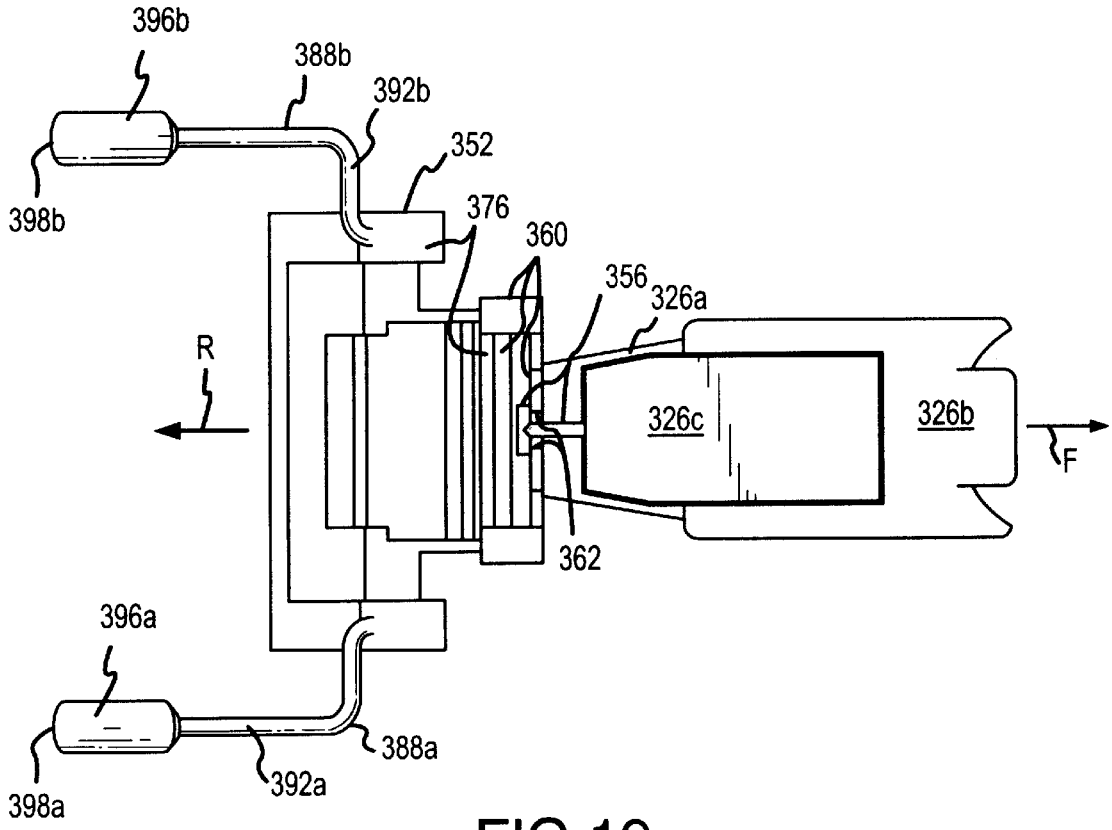
FIG. 19 is a bottom, plan view of the traction device and rear binding assembly of FIG. 18, with the ski and certain portions of the traction device being removed, and with the rear binding assembly being in a position when a downhill ski boot is out of the rear binding assembly.

FIGS. 18 illustrates the traction device 352 in its active position and when the ski boot 46 is not in the rear binding assembly 324. Whenever the ski boot 46 is not within the rear binding assembly 324, the traction device 352 will be in its active position. "Active" means that the free end 398*a*, 398*b* of each traction arm 388*a*, 388*b* is disposed below a reference plane which at least generally contains the lower surface 26 of the ski body 18 (in at least the same general manner discussed above in relation to the traction device 54). In this case the biasing mechanism associated with the rear binding assembly 324 advances the rear binding assembly 324 relative to the mounting bracket 328 at least generally in the direction of the arrow "F." At some point in time of the forward travel of the rear binding assembly 324, the latch pull arm 356, which is again attached to the rear binding assembly 324, engages the latch 360 to pivot the same at least initially generally away from the traction arm carrier 376. When the latching member 372 of the latch 360 becomes sufficiently disengaged from the latching member 384 of the traction arm carrier 376 as a result of the action of the latch pull arm 356 on the latch 360, the biasing forces provided by the traction arm carrier biasing spring 382 move the traction arm carrier 376 from the first traction arm carrier position illustrated in FIG. 20 to the second traction arm carrier position illustrated in FIG. 18. At this time the free ends 398*a*, 398*b* of the traction arms 388*a*, 388*b* are disposed below a reference plane which at least generally contains the lower surface 26 of the body 18 of the ski 10. Since the ski boot 46 is not disposed in the rear binding assembly 204 at this time, the active position of the traction device 352 illustrated in FIG. 18 may be characterized as providing a braking function for the downhill ski 10. That is, the traction device 352 in this type of active position retards, and more preferably stops, continued downhill travel of the ski 10 when the skier and ski 10 have become separated, such as typically results from a fall by the skier.

Figure 20:
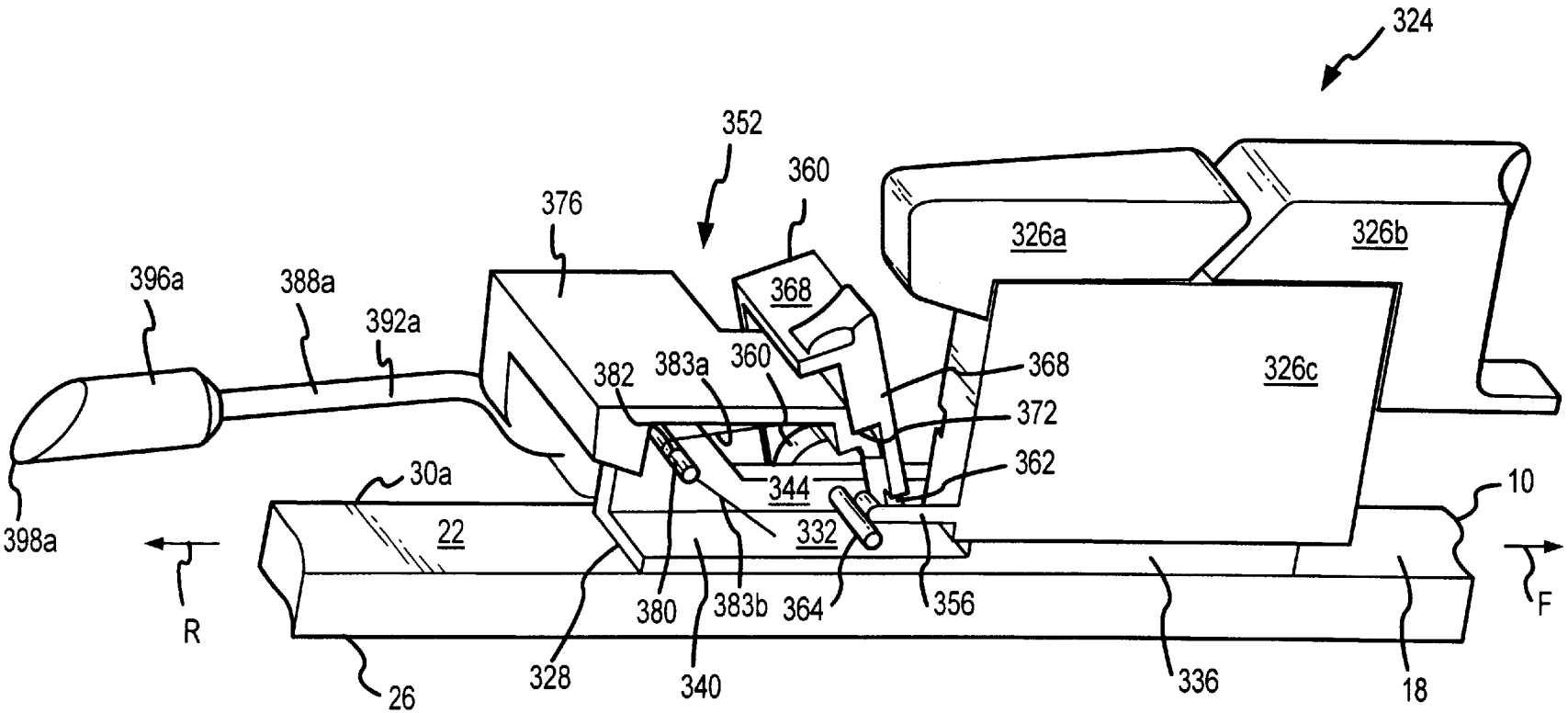
FIG. 20 is a perspective, cutaway view of the traction device and rear binding assembly of FIG. 18, with the rear binding assembly being in a position when a downhill ski boot is in the rear binding assembly, and with the traction device being in its non-traction position.
Figure 21:
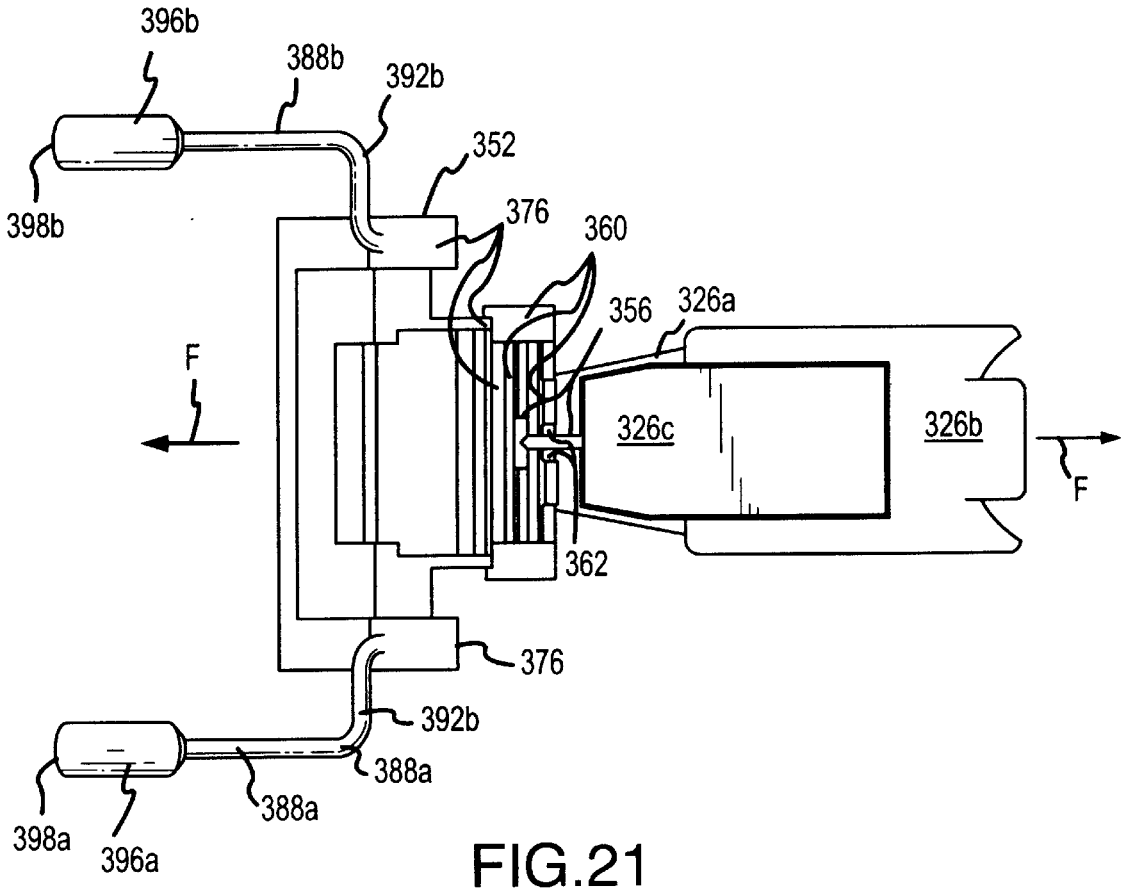
FIG. 21 is a bottom, plan view of the traction device and rear binding assembly of FIG. 18, with the ski and certain portions of the traction device being removed, and with the rear binding assembly being in a position when a downhill ski boot is in the rear binding assembly.

FIG. 20 illustrates the latch 360 being in its first latch position so as to retain the traction arm carrier 376 in its first traction arm carrier position, all at a time when the ski boot 46 is disposed within the rear binding assembly 4. This again corresponds with the inactive position for the traction device 352. Movement of the rear binding assembly 324 from the position illustrated in FIGS. 18–19 (where the ski boot 46 is not yet disposed within the rear binding assembly 324 and where the latch pull arm 356 is engaged with the latch 360) to the position illustrated in FIGS. 20–21 (where the ski boot 46 is disposed within the rear binding assembly 324) sufficiently disengages the latch pull arm 356 from the latch 360 (including being totally disengaged such that there is actually a space between the latch pull arm 356 and the latch 360). As a result: 1) the traction arm carrier 376 may be manually moved (e.g., by the skier using the downhill ski 10) from the second traction arm carrier position of FIG. 18 to the first traction arm carrier position of FIG. 20; and 2) the latch 360 may be manually moved (e.g., by the skier using the downhill ski 10) from the second latch position of FIG. 18 to the first latch position of FIG. 20. Engagement of the latching member 372 of the latch 360 with the latching member 384 of the traction arm carrier 376 at this time retains the traction device 352 in its inactive position, even though the ski boot 46 is engaged with the rear binding assembly 324. This then allows the ski 10 with the rear binding assembly 324 and traction device 352 to be used for normal downhill skiing operations as discussed above in relation to the traction device 54. That is, the free end 398*a*, 398*b* of each traction arm 388*a*, 388*b* is disposed above a reference plane which at least generally contains the lower surface 26 of the body 18 of the ski 10 so as to not interfere with normal downhill skiing operations. Conventional ski brakes cannot be manually manipulated in this manner, but are instead automatically returned to a "non-braking" position.

Figure 22:
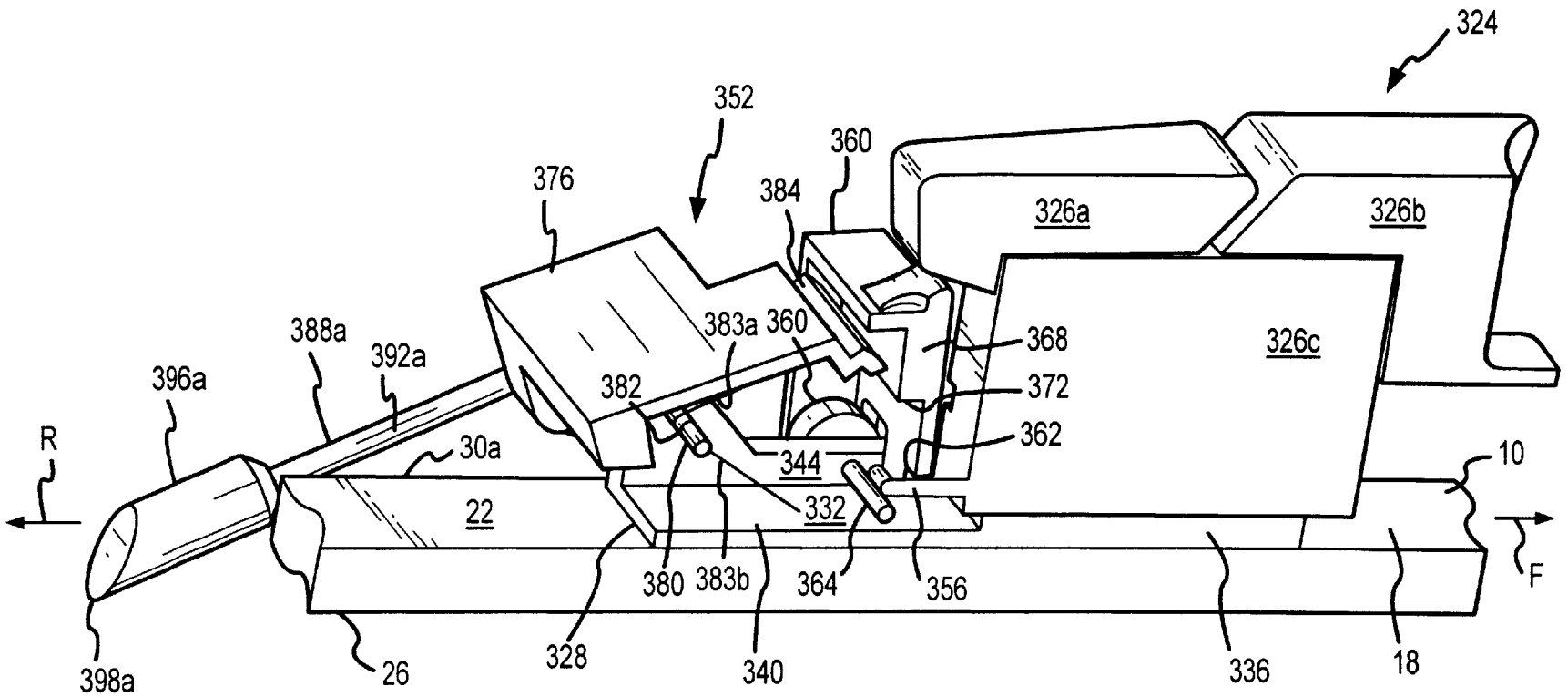
FIG. 22 is a perspective, cutaway view of the traction device and rear binding assembly of FIG. 18, with the rear binding assembly being in a position when a downhill ski boot is in the rear binding assembly, and with the traction device being in its traction position.
Figure 23:
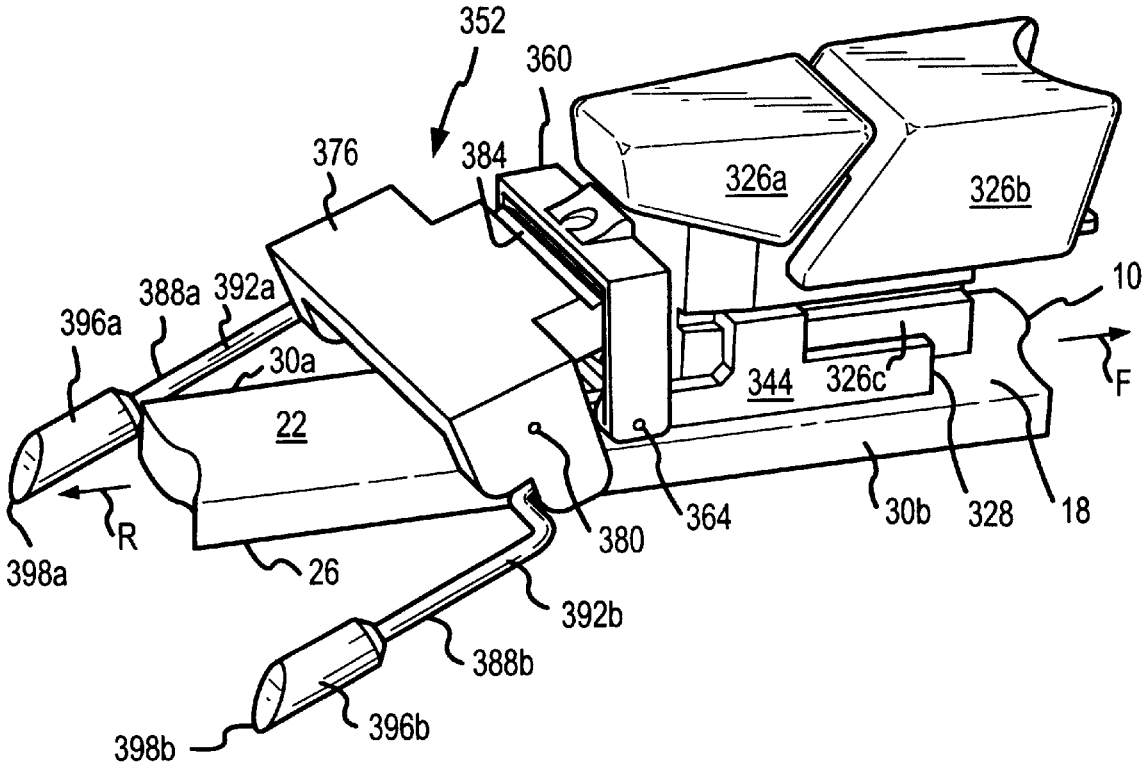
FIG. 23 is a perspective view of the traction device and rear binding assembly of FIG. 18, with the rear binding assembly being in a position when a downhill ski boot is in the rear binding assembly, and with the traction device being in its traction position.

The latch 360 may also be manually moved from the first latch position illustrated in FIGS. 20 to the second latch position illustrated in FIGS. 22–23 (e.g. by a skier using the ski 10) while the ski boot 46 is still disposed within the rear binding assembly 324. Movement of the latch 360 from its first latch position to its second latch position allows the traction arm carrier 376 to move from the first carrier arm position illustrated in FIG. 20 to the second carrier arm position illustrated in FIGS. 22–23. Forces again are exerted on the traction arm carrier 376 by the traction arm carrier biasing spring 382 to bias the traction arm carrier 376 to its second traction arm carrier position. Disposition of the traction arm carrier 376 in its second carrier position disposes the free end 398*a*, 398*b* of each traction arm 388*a*, 388*b* below a reference plane which at least generally contains the lower surface 26 of the body 18 of the ski 10. From this point on the traction device 352 functions at least substantially the same as the traction device 54 discussed above in relation to the operation of the ski 10.

The foregoing description of the present invention has been presented for purposes of illustration and description. Furthermore, the description is not intended to limit the invention to the form disclosed herein. For instance, other dimensions, materials, and/or configurations may be appropriate. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A downhill ski, comprising:

a downhill ski body comprising an upwardly curved nose and an elongated first member extending rearwardly from said nose at least generally along a first reference axis and which defines a longitudinal extent of said downhill ski body, wherein said downhill ski body comprises opposing upper and lower surfaces, wherein a reference plane is associated with said lower surface and is disposed in at least generally parallel relation with said lower surface, and wherein said downhill ski body further comprises first and second side surfaces which define a lateral extent of said downhill ski body;

a downhill ski binding disposed on said upper surface which comprises first and second binding members spaced along said first reference axis, wherein said first binding member is disposed between said nose and said second binding member, and wherein said downhill ski binding further comprises a latch trip member; and a traction device which comprises:

a traction device mount disposed on said upper surface of said downhill ski body and attached to said downhill ski body;

a traction arm carrier pivotally interconnected with said traction device mount and pivotable between at least first and second traction ann carrier positions;

a first traction arm mounted on said traction arm carrier, wherein at least a portion of said first traction arm is disposed beyond said first side surface of said downhill ski body and extends at least generally in a direction of a rear end of said downhill ski body at least when said traction arm carrier is disposed in said second traction arm carrier position, wherein said first traction arm further comprises a free end which is longitudinally spaced from said traction arm carrier in a direction of said rear end of said downhill ski body at least when said traction arm carrier is disposed in said second traction arm carrier position, wherein said free end of said first traction arm does not extend below said reference plane when said traction arm carrier is in said first traction arm carrier position, and wherein said free end of said first traction am is disposed below said reference plane when said traction arm carrier is in said second traction arm carrier position;

a traction arm carrier biasing member, wherein said traction arm carrier biasing member biases said traction arm carrier at least toward said second traction arm carrier position; and a latch movably interconnected with said traction device mount and which is movable between first and second latch positions, wherein said traction arm carrier is retained in said first traction arm carrier position by said latch when said latch is in said first latch position, wherein said traction arm carrier is disengaged from said latch when said latch is in said second latch position such that said traction arm carrier biasing member is then able to remove said traction arm carrier at least toward said second traction arm carrier position, wherein said latch trip member of said binding engages said latch in a manner so as to dispose said latch in said second latch position when a downhill ski boot in disposed out of said binding such that said latch disengages said traction arm carrier and said traction arm carrier biasing member is then able to move said traction arm carrier at least toward said second traction arm carrier position to in turn dispose said free end of said first traction arm below said reference plane associated with said lower surface of said downhill ski body such that said traction device functions as a downhill ski brakes wherein said latch trip member of said binding is sufficiently disengaged with said latch when said downhill ski boot is positioned in said binding in a manner so as to allow said latch to be in either of said first and second latch positions, wherein said latch comprises means for manually moving said latch from said first latch position to said second latch position while the downhill ski boot is disposed within said binding such that said latch disengages said traction arm carrier to allow said traction arm carrier biasing member to then move said traction arm carrier at least toward said second traction arm carrier position to in turn dispose said free end of said first traction arm below said reference plane associated with said lower surface of said downhill ski body such that said free end of said first traction aim is disposed in an orientation to provide traction when an operator of said downhill ski exerts a rearwardly directed force on said downhill ski so as to advance another downhill ski being used by the operator in a forward direction, and wherein said latch further comprises means for manually moving said latch from said second latch position to said first latch position while the downhill ski boot is disposed within said binding such that said traction arm carrier may be moved back to said first traction arm carrier position and be retained in said first traction arm carrier position by an engagement of said latch to in turn dispose said free end of said first traction arm so as to not extend below said reference plane associated with said lower surface of said downhill ski body to allow said first downhill ski to be used for normal downhill skiing operations.

2. A downhill ski, as claimed in claim 1, wherein:

said latch trip member is interconnected with a portion of said first binding member which moves in response to a change in position of a ski boot relative to said first binding member.

3. A downhill ski, as claimed in claim 1, wherein:

said latch trip member is interconnected with a portion of said second binding member which moves in response to a change in position of a ski boot relative to said first binding member.

4. A downhill ski, as claimed in claim 1, wherein:

said first traction arm also extends at least generally in a direction of said rear end of said ski body when said traction arm carrier is disposed in said first traction arm carrier position, and wherein said free end is also longitudinally spaced from said traction arm carrier in a direction of said rear end of said ski body when said traction arm carrier is disposed in said first traction arm carrier position.

5. A downhill ski, as claimed in claim 1, wherein:

said traction device further comprises:

a second traction arm interconnected with said traction arm carrier, wherein at least a portion of said second traction arm is disposed beyond said second side surface of said downhill ski body and extends at least generally in a direction of said rear end of said downhill ski body at least when said traction arm carrier is disposed in said second traction arm carrier position, wherein said second traction arm further comprises a free end which is longitudinally spaced from said traction arm carrier in a direction of said rear end of said downhill ski body at least when said traction arm carrier is disposed in said second traction arm carrier position, wherein said free end of said second traction arm does not extend below said reference plane when said traction arm carrier is in said first traction arm carrier position, and wherein said free end of said second traction arm is disposed below said reference plane when said traction arm carrier is in said second traction arm carrier position.

6. A downhill ski, as claimed in claim 1, wherein:

said traction arm carrier biasing member comprises a spring.

7. A downhill ski, as claimed in claim 1, wherein:

first binding member comprises first and second laterally spaced ski boot toe pieces pivotally interconnected with said ski body and a ski boot toe piece biasing spring which biases said first and second boot toe pieces toward each other, wherein said latch trip member is fixedly interconnected with said first boot toe piece.

8. A downhill ski, as claimed in claim 7, wherein:

said first and second boot toe pieces are pivotally interconnected with said traction device mount.

9. A downhill ski, as claimed in claim 1, wherein:

said second binding member is slidably interconnected with said downhill ski body for movement which is at least generally parallel with said first reference axis, wherein said latch trip member is fixedly interconnected with said second binding member.

10. A downhill ski, comprising:

a downhill ski body comprising an upwardly curved nose and an elongated first member extending rearwardly from said nose, wherein said downhill ski body comprises vertically spaced upper and lower surfaces, as well as laterally spaced first and second side surfaces;

a downhill ski binding disposed on said upper surface which comprises first and second longitudinally spaced binding members, wherein said first binding member is disposed between said nose and said second binding member;

a traction device which comprises a first traction arm which is movable between first and second traction arm positions, wherein at least a portion of sad first traction arm is disposed beyond said first side surface of said downhill ski body and extends at least generally in a direction of a rear end of said downhill ski body to a free end of said first traction arm at least when said first traction arm is disposed in said second traction arm position, wherein said free end of said first traction arm does not extend below said lower surface of said downhill ski body when said first traction arm is in said first traction arm position so as to allow said first downhill ski to be used for normal downhill skiing operations, and wherein said free end of said first traction arm extends below said lower surface of said first downhill ski body when said first traction arm is in said second traction arm position;

first means for automatically disposing said first traction arm in said second traction arm position when a downhill ski boot is out 6f said downhill ski binding such that said first traction arm functions as a ski brake;

second means for selectively disposing said first traction arm in said first traction arm position when the downhill ski boot is in said downhill ski binding to allow said downhill ski to be used for normal downhill skiing operations; and third means for selectively disposing said first traction arm in said second traction arm position when the downhill ski boot is in said downhill ski binding such that said free end of said first traction arm is disposed below said lower surface of said ski body and in an orientation to provide traction when an operator of said downhill ski exerts a rearwardly directed force on said downhill ski so as to advance another downhill ski being used by the operator in a forward direction.

11. A downhill ski, as claimed in claim 10, wherein:

said traction device further comprises:

a second traction arm which is movable between said first and second traction arm positions, wherein at least a portion of said second traction arm is disposed beyond said second side surface of said ski body and extends at least generally in a direction of said rear end of said downhill ski body to a free end of said second traction arm at least when said second traction arm is disposed in said second traction arm position, wherein said free end of said second traction arm does not extend below said lower surface when said second traction arm is in said second traction arm position, and wherein said free end of said second traction arm extends below said lower surface when said second traction arm is in said second traction arm position, wherein:

said first means further comprises means for automatically disposing said second traction arm in said second traction arm position when said downhill ski boot is out of said binding;

said second means further comprises means for selectively disposing said second traction arm in said second traction arm position When said downhill ski boot is in said binding; and said third means further comprises means for selectively disposing said second traction arm in said second traction arm position when said downhill ski boot is in said binding.

12. A downhill ski, as claimed in claim 10, wherein:

said traction device is integrated with said first binding member.

13. A downhill ski, as claimed in claim 10, wherein:

said traction device is integrated with said second binding number.

14. A downhill ski, as claimed in claim 10, wherein:

said first binding member is in a first binding member position when said ski boot is out of said binding, is in a second binding member position when said ski boot is in said binding, and is movable between said first and second binding member positions, wherein said traction device comprises a latch which retains said first traction member in said first traction member position, as well as a latch activation member, wherein said latch activation member is fixedly interconnected with said first binding member and moves along with said first binding member when moving between said first and second binding members positions, and wherein said latch activation member engages said latch to release said first traction arm and allow said first traction arm to proceed to said second traction arm position when said first binding member moves from said second binding member position to said first binding member position.

15. A downhill ski, as claimed in claim 10, wherein:

said second binding member is in a first binding member position when said ski boot is out of said binding, is in a second binding member position when said ski boot is in said binding, and is movable between said first and second binding member positions, wherein said traction device comprises a latch which retains said first traction member in said first traction member position, as well as a latch activation member, wherein said latch activation member is fixedly interconnected with said second binding member and moves along with said second binding member when moving between said first and second binding members positions, and wherein said latch activation member engages said latch to release said first traction arm and allow said first traction arm to proceed to said second traction arm position when said second binding member moves from said second binding member position to said first binding member position.

16. A downhill ski, as claimed in claim 10, wherein:

wherein said traction device comprises a latch which is manually movable between first and second latch positions, wherein said first traction arm is retained in said first traction arm position by said latch when in said first latch position, and wherein said first traction arm is allowed to proceed to said second traction arm position when said latch is in said second latch position, wherein said second and third means each comprise said latch.

* * * * *

UNITED STATES PATENT AND TRADEMARK OFFICE

CERTIFICATE OF CORRECTION

PATENT NO. : 6,390,491 B1
DATED : May 21, 2002
INVENTOR(S) : Hunter

It is certified that error appears in the above-identified patent and that said Letters Patent is hereby corrected as shown below:

Column 22,
Line 2, please delete “am” and insert therefor -- arm --
Line 17, please delete “remove” and insert therefor -- move --
Line 31, please delete “brakes” and insert therefor -- brake, --
Line 47, please delete “aim” and insert therefor -- arm --

Column 24,
Line 1, please delete “sad” and insert therefor -- said --
Line 19, please delete “6f” and insert therefor -- of --
Line 59, please delete “When” and insert therefor -- when --

Signed and Sealed this

Fifth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,390,491 B1
DATED : May 21, 2002
INVENTOR(S) : Hunter

It is certified that error appears in the above-identified patent and that said Letters Patent is hereby corrected as shown below:

Column 22,
Line 2, please delete “am” and insert therefor -- arm --.
Line 17, please delete “remove” and insert therefor -- move --.
Line 31, please delete “brakes” and insert therefor -- brake, --.
Line 47, please delete “aim” and insert therefor -- arm --.

Column 24,
Line 1, please delete “sad” and insert therefor -- said --.
Line 19, please delete “6f” and insert therefor -- of --.
Line 59, please delete “When” and insert therefor -- when --.

Column 25,
Line 3, delete “number” and insert therefor -- member --.

Column 26,
Line 16, delete “wherein said” and insert therefor -- said --.

This certificate supersedes Certificate of Correction issued November 5, 2002.

Signed and Sealed this

First Day of November, 2005

JON W. DUDAS
*Director of the United States Patent and Trademark Office*